US008400375B2

(12) United States Patent
Tanaka

(10) Patent No.: US 8,400,375 B2
(45) Date of Patent: Mar. 19, 2013

(54) PROCESSING METHOD OF FLAT PANEL DISPLAY APPARATUS

(75) Inventor: Masanaga Tanaka, Gifu (JP)

(73) Assignees: Sony Corporation, Tokyo (JP); AU Optronics Corporation, Taiwan (CN)

( * ) Notice: Subject to any disclaimer, the term of this patent is extended or adjusted under 35 U.S.C. 154(b) by 674 days.

(21) Appl. No.: 12/349,665

(22) Filed: Jan. 7, 2009

(65) Prior Publication Data

US 2009/0179834 A1 Jul. 16, 2009

(30) Foreign Application Priority Data

Jan. 10, 2008 (JP) ..... 2008-003227

(51) Int. Cl.
*G09G 3/30* (2006.01)

(52) U.S. Cl. ..... 345/76

(58) Field of Classification Search ..... None
See application file for complete search history.

(56) References Cited

U.S. PATENT DOCUMENTS 6,580,223 B2 * 6/2003 Konishi et al. ..... 315/169.3
6,900,066 B2 * 5/2005 Toyota et al. ..... 438/20

FOREIGN PATENT DOCUMENTS

JP 2003-068205 A 3/2003
JP 2003-123650 A 4/2003
JP 2004-031336 A 1/2004
JP 2007-193190 A 8/2007

* cited by examiner

*Primary Examiner* — K. Wong
(74) *Attorney, Agent, or Firm* — Wolf, Greenfield & Sacks, P.C.

(57) ABSTRACT

A processing method of a flat panel display apparatus in which a cathode panel having electron emitting regions and an anode panel having phosphor regions and an anode electrode are joined is provided. A predetermined voltage is applied to each electron emitting region, thereby allowing electrons to be emitted therefrom. In a predetermined row, initial electron emitting states in the electron emitting regions are measured. After that, a voltage higher than that of the electron emitting region in a row showing the low initial electron emitting state is applied to the electron emitting region in the row showing the high initial electron emitting state for a predetermined time, thereby performing aging.

13 Claims, 11 Drawing Sheets

PROCESSING METHOD OF FLAT PANEL DISPLAY APPARATUS

CROSS REFERENCES TO RELATED APPLICATIONS

This application claims priority to Japanese Patent Application No. JP 2008/003227 filed on Jan. 10, 2008, the entire contents of which being incorporated herein by reference.

BACKGROUND OF THE INVENTION

1. Field of the Invention

The invention relates to a processing method of a flat panel display apparatus.

2. Description of the Related Arts

As an image display apparatus in place of a cathode ray tube (CRT) that is a mainstream at present, various kinds of flat panel display apparatuses are being examined. As such flat panel display apparatuses, for example, a liquid crystal display apparatus (LCD), an electrolumescence display apparatus (ELD), and a plasma display apparatus (PDP) can be mentioned. A flat panel display apparatus in which a cathode panel having electron emitting devices has been assembled is also being developed. As electron emitting devices, a cold cathode field electron emitting device, a metal/insulating film/metal type device (also referred to as an MIM device), and a surface conduction electron emitting device have been known. Attention is paid to the flat panel display apparatus in which the cathode panel having the electron emitting devices formed by those cold cathode electron sources has been assembled from a viewpoint of a color display of high resolution, a high response speed, and high luminance and from a viewpoint of low electric power consumption.

The cold cathode field electron emitting display apparatus (hereinbelow, there is a case where it is abbreviated to a display apparatus) as a flat panel display apparatus in which the cold cathode field electron emitting devices as electron emitting devices have been assembled generally has the following construction. That is, a cathode panel CP having a plurality of cold cathode field electron emitting devices (hereinbelow, there is a case where they are abbreviated to field emission devices) and an anode panel AP having phosphor regions which are excited and emit light by a collision with electrons emitted from the field emission devices are arranged so as to face each other through a space which has been maintained in a high vacuum state, and the cathode panel CP and the anode panel AP are joined through a joint member in a peripheral edge portion. The cathode panel CP has electron emitting regions corresponding to subpixels arranged in a 2-dimensional matrix form. One or a plurality of field emission devices are provided in each electron emitting region. As field emission devices, a spindt type, a flat type, an edge type, a plane type, and the like can be mentioned.

For example, FIG. 7 shows a schematic diagram with a part cut away of a representative display apparatus having spindt type field emission devices. FIG. 8 shows a schematic exploded perspective view of a part of the cathode panel CP and a part of the anode panel AP at the time when the cathode panel CP and the anode panel AP are exploded. The spindt type field emission devices constructing the display apparatus include: cathode electrodes 11 formed on a supporting plate 10; an insulating layer 12 formed over/on the supporting plate 10 and the cathode electrodes 11; gate electrodes 13 formed on the insulating layer 12; opening portions 14 formed in the gate electrodes 13 and the insulating layer 12 (first opening portions 14A formed in the gate electrodes 13 and second opening portions 14B formed in the insulating layer 12); and conical electron emitting portions 15 formed on the cathode electrodes 11 locating in bottom portions of the opening portions 14. An interlayer insulating layer 16 is formed on the insulating layer 12. A focusing electrode 17 is formed on the interlayer insulating layer 16.

In the display apparatus, the cathode electrode 11 is a belt-shaped electrode extending in the column direction (Y direction) and the gate electrode 13 is a belt-shaped electrode extending in the row direction (X direction) different from the Y direction. Generally, the cathode electrode 11 and the gate electrode 13 are formed in such directions that projection images of both electrodes 11 and 13 cross perpendicularly. An overlapped region where the belt-shaped cathode electrode 11 and the belt-shaped gate electrode 13 overlap is an electron emitting region EA and corresponds to one subpixel. The electron emitting regions EA are ordinarily arranged in a valid region (a center display region which performs a display function as a practical function as a flat panel display apparatus; an invalid region is located outside of the valid region and surrounds the valid region in a picture frame shape) of the cathode panel CP in a 2-dimensional matrix form.

The anode panel AP has such a structure that phosphor regions 22 (specifically speaking, red light emitting phosphor regions 22R, green light emitting phosphor regions 22G, and blue light emitting phosphor regions 22B) having a predetermined pattern are formed on a substrate 20 and the phosphor regions 22 are covered with an anode electrode 24. Intervals among the phosphor regions 22 are filled with a light absorbing layer (black matrix) 23 made of a light absorbing material such as carbon, thereby preventing the occurrence of a color turbidity of a display image and an optical crosstalk. Each of the phosphor regions 22 constructing one subpixel is surrounded by partition walls 21. A plane shape of the partition wall 21 is a lattice shape (pattern like two pairs of intersecting parallel lines). Spacers 40 extending in the row direction (X direction), spacer holding portions 25, and joint members 26 are provided in the diagram. The partition walls and spacers are not illustrated in FIG. 8.

One subpixel is constructed by the electron emitting region EA on the cathode panel side and the phosphor region 22 on the anode panel side which faces the electron emitting region EA. Picture elements (pixels) are arranged in the valid region on the order of, for example, hundred thousands of pixels to millions of pixels. In the display apparatus which performs a color display, one picture elements (one pixel) is constructed by a set of a red light emitting subpixel, a green light emitting subpixel, and a blue light emitting subpixel. The anode panel AP and the cathode panel CP are arranged so that the electron emitting region EA faces the phosphor region 22 and are joined through the joint members 26 in the peripheral edge portion, and thereafter, they are evacuated and sealed, so that the display apparatus can be manufactured. A space surrounded by the anode panel AP, cathode panel CP, and joint members 26 is held in a high vacuum state (for example, $1\times10^{-3}$ Pa or less). Therefore, unless the spacers 40 are disposed between the anode panel AP and the cathode panel CP, the display apparatus will be damaged by the atmospheric pressure. Generally, an antistatic film 40A made of, for example, $CrO_x$ is formed on the side surface of the spacer 40.

When driving the display apparatus, a line-sequential driving system is often used. The line-sequential driving system is a method whereby the electrodes in the group of electrodes which cross in a matrix form, for example, the gate electrodes 13 are assumed to be scanning electrodes (the number of scanning electrodes is equal to N), the cathode electrodes 11 are assumed to be data electrodes (the number of data electrodes is equal to M), the gate electrodes 13 are selected and scanned, and an image is displayed on the basis of a signal to the cathode electrodes 11, thereby forming one picture plane. In such a line-sequential driving system, the electron emission from each electron emitting region EA is executed only for a selecting time of the scanning electrodes, that is, for a duty period of time of the scanning electrodes. The duty period of time is equal to a time of a few seconds obtained by dividing a refreshing time (for example, 16.7 msec in the case of 60 Hz) of the frame by N.

More specifically speaking, a negative voltage is relatively applied to the cathode electrode 11 from a cathode electrode control circuit 31, a positive voltage is relatively applied to the gate electrode 13 from a gate electrode control circuit 32, and a positive voltage which is further higher than that to the gate electrode 13 is applied to the anode electrode 24 from an anode electrode control circuit 33. In the case of displaying by the display apparatus as mentioned above, a video signal is inputted to the cathode electrode 11 from the cathode electrode control circuit 31 and a scan signal is inputted to the gate electrode 13 from the gate electrode control circuit 32. Electrons are emitted from the electron emitting portion 15 on the basis of a quantum tunnel effect by an electric field that is caused when voltages are applied to the cathode electrode 11 and the gate electrode 13. The emitted electrons are attracted to the anode electrode 24, pass through the anode electrode 24, and collide with the phosphor region 22. Thus, the phosphor region 22 is excited and emits light and a desired image can be obtained. That is, the operation of the cold cathode field electron emitting display apparatus is fundamentally controlled by the voltage which is applied to the gate electrode 13 and the voltage which is applied to the cathode electrode 11.

When the electrons emitted from the electron emitting region EA locating near the spacer 40 pass through the anode electrode 24 in the anode panel AP and collide with the phosphor region 22, a part of the electrons are backwardly scattered in the phosphor region 22. A part of the back scattering electrons collide with the spacer 40. Thus, such a phenomenon that a gas adsorbed to the spacers 40 is released, molecules or the like of the released gas are adhered or adsorbed onto the surface of the electron emitting portion 15 constructing the electron emitting region EA locating near the spacer 40, and electron emitting characteristics in the electron emitting portion 15 are changed occurs. When such a phenomenon occurs, an amount of electron emission from the electron emitting region EA locating near the spacer 40 changes, so that a difference occurs between an electron emitting state in the electron emitting region EA locating near the spacer 40 and an electron emitting state in the electron emitting region EA which is not located near the spacer 40 (the electron emitting region EA locating at a position away from the spacer 40).

Such states are schematically shown in FIGS. 9A and 9B. An anode current value shown on an axis of ordinate in FIGS. 9A and 9B is a value of an anode current flowing between the electron emitting region and the anode electrode by the electrons emitted from the M electron emitting regions which occupy one row. An axis of abscissa indicates positions of the electron emitting regions along the column direction (Y direction). An alternate long and short dash line extending vertically in FIGS. 9A and 9B indicates positions where the spacers are arranged. In the example shown in FIG. 9A, an amount of electrons which are emitted from the electron emitting region locating near the spacer is larger than an amount of electrons which are emitted from the electron emitting region locating at a position away from the spacer. In the example shown in FIG. 9B, the amount of electrons which are emitted from the electron emitting region locating near the spacer is smaller than an amount of electrons which are emitted from the electron emitting region locating at a position away from the spacer. Whether the electron emitting state becomes the state shown in FIG. 9A or the state shown in FIG. 9B depends on the specifications or the like of the display apparatus. There is a case where a difference of luminance in the display apparatus lies within a range from a few % to ten and a few % depending on a difference between the amounts of emitted electrons. Such a problem that the picture quality is remarkably deteriorated and the spacer is visually perceived due to such a luminance difference also occurs.

An aging change occurs in the emitting state of the electrons from the electron emitting region. Such a state is shown as examples in FIGS. 10, 11A, 11B, and 11C. An anode current relative value shown on an axis of ordinate in each of FIGS. 10, 11A, 11B, and 11C is a value (unit: %) obtained by dividing (the value of the anode current in the electron emitting region locating near the spacer) by (the value of the anode current in the electron emitting region locating at the position that is sufficiently away from the spacer). An axis of abscissa indicates an elapsed time (although its unit may be arbitrarily set, it is shown by a logarithm scale). In the example shown in FIG. 10, although the anode current relative value changes together with the elapse of an operating time, its change amount differs depending on an initial anode current relative value. Moreover, when a long time elapses, the change amount is approximately converged into a certain value. For example, when the initial anode current relative value is equal to about 106%, the change amount changes to about 98%. when the initial anode current relative value is equal to about 100%, the change amount changes to about 96%. when the initial anode current relative value is equal to about 94%, the change amount changes to about 95%. when the initial anode current relative value is equal to about 90%, the change amount changes to about 96%. It will be understood from FIGS. 11A, 11B, and 11C that change ratios (inclinations of straight lines in FIGS. 11A, 11B, and 11C) of the anode current relative value to the time differ depending on the initial anode current relative value.

SUMMARY OF THE INVENTION

For example, in JP-A-2007-193190 (Patent Document 1), there has been disclosed means for solving such a problem that a difference occurs, with the elapse of an operating time, between electron emitting characteristics in an electron emitting region locating near a spacer and electron emitting characteristics in an electron emitting region locating at a position that is sufficiently away from the spacer. That is, the technique disclosed in Patent Document 1 relates to an operating method at the time of an actual displaying operation of a flat panel display apparatus, whereby a difference between an electron emitting state in the electron emitting region locating near the spacer and electron emitting state in the electron emitting region which is not located near the spacer can be reduced as much as possible. Such a technique disclosed in Patent Document 1 is a very effective technique. However, it is further preferable that the difference between the electron emitting state in the electron emitting region locating near the spacer and electron emitting state in the electron emitting region which is not located near the spacer is made to approach a desired state as close as possible by a process before a factory shipping after completion of manufacturing of a display apparatus, that is, before the full-dress actual displaying operation of the flat panel display apparatus. Further, although an aging change can occur in the emitting state of the electrons from the electron emitting region, it is preferable to reduce a variation in such an aging change as much as possible as a whole display apparatus.

It is, therefore, desirable to provide a processing method of a flat panel display apparatus which can make a difference between electron emitting states in electron emitting regions approach a desired state before a factory shipping after completion of manufacturing of a flat panel display apparatus.

According to first, second, and third aspects of embodiments of the present invention, there is provided a processing method of a flat panel display apparatus in which a cathode panel having electron emitting regions arranged on a supporting plate along a row direction (X direction) and a column direction (Y direction) in a 2-dimensional matrix form and an anode panel having phosphor regions and an anode electrode are joined in a peripheral portion, spacers are arranged between the cathode panel and the anode panel along the row direction (X direction), and a space sandwiched between the cathode panel and the anode panel is held in a vacuum state.

According to the first aspect of the embodiment of the present invention, there is provided the processing method of the flat panel display apparatus, comprising the steps of:

(A) applying a predetermined voltage to each of the electron emitting regions to thereby allow electrons to be emitted from each of the electron emitting regions and measuring initial electron emitting states in the electron emitting regions in a predetermined row; and (B) executing an aging process for applying a voltage, for a predetermined time, higher than that of the electron emitting region in the row showing the low initial electron emitting state to the electron emitting region in the row showing the high initial electron emitting state.

According to the second aspect of the embodiment of the present invention, there is provided the processing method of the flat panel display apparatus, comprising the steps of:

(A) applying a predetermined voltage to each of the electron emitting regions to thereby allow electrons to be emitted from each of the electron emitting regions and measuring initial electron emitting states in the electron emitting regions in a predetermined row; and (B) executing an aging process for applying a voltage, for a predetermined time, based on a difference between a measurement value of the initial electron emitting state in each of the electron emitting regions and a predetermined electron emitting state reference value to each of the electron emitting regions.

According to the third aspect of the embodiment of the present invention, there is provided the processing method of the flat panel display apparatus, comprising the step of executing an aging process for applying a voltage, for a predetermined time, higher than that of the electron emitting region in a row which is presumed to show the low initial electron emitting state to the electron emitting region in a row which is presumed to show the high initial electron emitting state.

The step (A) in the processing method of the flat panel display apparatus according to the first or second aspect of the invention is referred to as "initial electron emitting state measuring step" for convenience of explanation and the step (B) is referred to as "aging processing step" for convenience of explanation. In the processing method of the flat panel display apparatus according to the first, second, or third aspect of the invention (hereinbelow, there is a case where those processing methods are generally simply referred to as "the processing method of the flat panel display apparatus of the invention"), "the electron emitting region in the row showing the high initial electron emitting state (or the row which is presumed to show the high initial electron emitting state)" is referred to as "high electron emitting row" for convenience of explanation and "the electron emitting region in the row showing the low initial electron emitting state (or the row which is presumed to show the low initial electron emitting state)" is referred to as "low electron emitting row" for convenience of explanation.

In the processing method of the flat panel display apparatus of the invention, at a point of time of completion of the aging process, it is preferable to set an aspect in which a difference between the electron emitting state after the aging process of the high electron emitting row and the electron emitting state after the aging process of the low electron emitting row is equal to a desired electron emitting state difference. As "a desired electron emitting state", an aspect in which the difference between the electron emitting state after the aging process of the high electron emitting row and the electron emitting state after the aging process of the low electron emitting row is made to approach zero as close as possible can be mentioned, or an aspect in which the former electron emitting regions are in the electron emitting state lower than that of the latter electron emitting regions or an aspect in which the former electron emitting regions are in the electron emitting state higher than that of the latter electron emitting regions as will be explained hereinbelow can be also mentioned.

As mentioned above, according to the above aspects, at the point of time of completion of the aging process, the electron emitting state after the aging process of the high electron emitting row can be set to the electron emitting state lower than the electron emitting state after the aging process of the low electron emitting row. Such a construction is referred to as a "first construction" for convenience of explanation. It is preferable to apply the first construction to a construction in which the electron emitting regions showing the high initial electron emitting state are close (or adjacent) to the spacer. The electron emitting regions showing the low initial electron emitting state are located in other regions (specifically speaking, the regions which are not close (or adjacent) to the spacer) and occupy the majority rows. Such a case is referred to as a "case A" for convenience of explanation.

In the first construction including such a preferred construction, it is preferable to use a construction in which, at the point of time of completion of the aging process, the electron emitting state after the aging process of the high electron emitting row is such an electron emitting state that the aging change ratio of the electron emitting state at the time of the actual displaying operation in the flat panel display apparatus lies within a predetermined range. Further, in the first construction including such a preferred construction as described above, it is preferable that in the actual displaying operation state in the flat panel display apparatus, the electron emitting state of the electron emitting regions is controlled in such a manner that when a same drive signal is inputted, the electron emitting state of the high electron emitting row and the electron emitting state of the low electron emitting row are equalized. More specifically speaking, it is preferable to control the electron emitting state of the high electron emitting row to a desired state.

Or, in the foregoing aspects, it is possible to use a construction in which at the point of time of completion of the aging process, the electron emitting state after the aging process of the high electron emitting row is set to the electron emitting state higher than the electron emitting state after the aging process of the low electron emitting row. Such a construction is referred to as a "second construction" for convenience of explanation. It is preferable to apply the second construction to a construction in which the electron emitting regions showing the low initial electron emitting state are close (or adjacent) to the spacer. The electron emitting regions showing the high initial electron emitting state are located in other regions (specifically speaking, the regions which are not close (or adjacent) to the spacer) and occupy the majority rows. Such a case is referred to as a "case B" for convenience of explanation.

In the second construction including such a preferred construction, it is preferable to use a construction in which at the point of time of completion of the aging process, the electron emitting state after the aging process of the low electron emitting row is such an electron emitting state that the aging change ratio of the electron emitting state at the time of the actual displaying operation in the flat panel display apparatus lies within a predetermined range. Further, in the second construction including such a preferred construction as described above, it is preferable that in the actual displaying operation state in the flat panel display apparatus, the electron emitting state of the electron emitting regions is controlled in such a manner that when the same drive signal is inputted, the electron emitting state of the high electron emitting row and the electron emitting state of the low electron emitting row are equalized. More specifically speaking, it is preferable to control the electron emitting state of the low electron emitting row to a desired state.

Generally, the aging change occurs in the electron emitting state at the time of the actual displaying operation in the flat panel display apparatus. In the preferred construction of the first construction or the second construction, the aging process is controlled so that the electron emitting state after the aging process of the high electron emitting row or the electron emitting state after the aging process of the low electron emitting row becomes such an electron emitting state that the aging change ratio of the electron emitting state at the time of the actual displaying operation in the flat panel display apparatus lies within a predetermined range as described above. The wording "the aging change ratio lies within a predetermined range" means that, in the first construction, for example, the aging change state of the electron emitting state of the high electron emitting row approaches the aging change state of the electron emitting state of the low electron emitting row as close as possible. For example, in the second construction, it means that the aging change state of the electron emitting state of the low electron emitting row approaches the aging change state of the electron emitting state of the high electron emitting row as close as possible. In order to decide such an electron emitting state that the aging change ratio lies within the predetermined range, it is sufficient to execute such an operation that aging change data of the anode current relative value mentioned above is collected in many flat panel display apparatuses.

In the processing methods of the flat panel display apparatus of the invention including the various kinds of preferred aspects and constructions described above (hereinbelow, there is a case where they are simply referred to as "the invention"), the line-sequential driving system can be mentioned as a driving system of the flat panel display apparatus. Specifically speaking, the line-sequential driving system is a system in which assuming that the number of rows is equal to N and the number of columns is equal to M, the operation for applying a same row voltage $V_{Row}$ to each of the M electron emitting regions arranged on each row and, at the same time, applying a column voltage $V_{Col}$ to the M electron emitting regions arranged on this row is sequentially executed with respect to the first to Nth rows. In the initial electron emitting state measuring step, it is sufficient to apply a same row voltage $V_{Ini\text{-}Row}$ and a same column voltage $V_{Ini\text{-}Col}$ to the respective electron emitting regions. In the aging processing step, the row voltage $V_{Row}$ is properly changed depending on the row. The column voltage $V_{Col}$ which is applied to the M electron emitting regions arranged on one row may be constant or different.

In the processing method of the flat panel display apparatus according to the first aspect of the invention, in the initial electron emitting state measuring step, a predetermined voltage $V_{Ini\text{-}Fix}$ is applied to the electron emitting regions, thereby allowing electrons to be emitted from each electron emitting region. However, the predetermined voltage $V_{Ini\text{-}Fix}$ to be applied to the electron emitting regions is essentially arbitrary. For example, it can be set to a voltage corresponding to the maximum drive signal at the time of the actual displaying operation of the flat panel display apparatus. The initial electron emitting states in the electron emitting regions are measured on the predetermined row. In this instance, the predetermined row can be set to all rows constructing the flat panel display apparatus or can be also set to one or a plurality of rows adjacent to the spacer and to one or a plurality of rows locating at an intermediate position between the spacers. As a method of measuring the initial electron emitting states in the electron emitting regions, for example, the following method can be mentioned: a method whereby the light emitting states of the phosphor regions corresponding to the electron emitting regions are measured by using a CCD camera or the like; or a method whereby the anode current flowing between the electron emitting region and the anode electrode is measured by the electrons emitted from the electron emitting region. Now, $V_{Ini\text{-}Fix}$ can be expressed by, for example, $|V_{Row}-V_{Col}|$.

In the processing method of the flat panel display apparatus according to the first aspect of the invention, in the aging processing step, the voltage higher than that of the low electron emitting row is applied to the high electron emitting row for a predetermined time. However, specifically speaking, for example, a predetermined high voltage $V_{H\text{-}Fix}$ may be applied to the high electron emitting row and, for example, a predetermined low voltage $V_{L\text{-}Fix}$ may be applied to the low electron emitting row. Or, it is also possible to use such a construction that an electron emitting state reference value is predetermined, a voltage $V_{H\text{-}Var}$ which is applied to the high electron emitting row is decided on the basis of a difference between the initial electron emitting state measurement value of the high electron emitting row and the electron emitting state reference value, and a voltage $V_{L\text{-}Var}$ which is applied to the low electron emitting row is decided on the basis of a difference between the initial electron emitting state measurement value of the low electron emitting row and the electron emitting state reference value. Those voltages can be also expressed by, for example, $|V_{row}-V_{Col}|$.

Or, in the foregoing case A, it is also possible to use such a construction that a mean value of all initial electron emitting state measurement values of the low electron emitting row is used as a reference value, the voltage $V_{H\text{-}Var}$ which is applied to the high electron emitting row is decided on the basis of the difference between the initial electron emitting state measurement value of the high electron emitting row and the reference value, and for example, the predetermined low voltage $V_{L\text{-}Fix}$ is applied to the low electron emitting row. On the other hand, in the foregoing case B, it is also possible to use such a construction that a mean value H of the initial electron emitting state measurement values of the high electron emitting row is obtained, a mean value L of the initial electron emitting state measurement values of the low electron emitting row is obtained, and on the basis of the mean values H and L, for example, the predetermined high voltage $V_{H\text{-}Fix}$ is applied to the high electron emitting row, and, for example, the predetermined low voltage $V_{L\text{-}Fix}$ is applied to the low electron emitting row.

In the aging processing step, a time during which the voltage is applied is essentially arbitrary and may be decided by executing various tests. However, for example, a time with a range from about a few minutes to hundreds of hours can be shown as an example. This is true of the processing method of the flat panel display apparatus according to the second or third aspect of the invention.

In the processing method of the flat panel display apparatus according to the third aspect of the invention, the row which is presumed to show the high initial electron emitting state and the row which is presumed to show the low initial electron emitting state can be determined by accumulating data by executing a step similar to that in the initial electron emitting state measuring step in the processing method of the flat panel display apparatus according to the first or second aspect of the invention to the many flat panel display apparatuses. Although the "high voltage" is applied for a predetermined time, specifically speaking, for example, it is sufficient to apply the predetermined high voltage $V_{H\text{-}Fix}$ to the row (high electron emitting row) which is presumed to show the high initial electron emitting state and to apply the predetermined low voltage $V_{L\text{-}Fix}$ to the row (low electron emitting row) which is presumed to show the low initial electron emitting state.

In the embodiment of the invention, which degree of the voltage should be applied to the high electron emitting row or the low electron emitting row can be determined by accumulating data by executing steps similar to the initial electron emitting state measuring step and an anneal processing step in the processing method of the flat panel display apparatus according to the first or second aspect of the invention to the many flat panel display apparatuses.

In the embodiment of the invention, as for the supporting plate constructing the cathode panel or the substrate constructing the anode panel, it is sufficient that the surfaces of those substrates which face each other are made of insulating members. As such substrates, there can be mentioned: a glass substrate; a glass substrate in which an insulating coating film is formed on the surface; a quartz substrate; a quartz substrate in which an insulating coating film is formed on the surface; and a semiconductor substrate in which an insulating coating film is formed on the surface. It is preferable to use the glass substrate or the glass substrate in which the insulating coating film is formed on the surface from a viewpoint of reduction in manufacturing costs. As a glass substrate, for example, there can be mentioned: high strain point glass; low alkali glass; soda glass $Na_2O.CaO.SiO_2$; borosilicate glass $Na_2O.B_2O_3.SiO_2$; forsterite glass $2MgO.SiO_2$; lead glass $Na_2O.PbO.SiO_2$; and no-alkali glass.

In the cathode panel in the embodiment of the invention, it is preferable that the projection image in the row direction (X direction) and the projection image in the column direction (Y direction) cross perpendicularly, that is, the row direction and the column direction cross perpendicularly from a viewpoint of simplification of the structure of the flat panel display apparatus. In the cathode panel, it is also preferable that the projection image of the cathode electrode and the projection image of the gate electrode cross perpendicularly from a viewpoint of simplification of the structure of the cold cathode field electron emitting display apparatus. The gate electrode extends in the row direction (X direction) and the cathode electrode extends in the column direction (Y direction).

In the embodiment of the invention, as a combination (M, N) of the number M of columns and the number N of rows, specifically speaking, some of the following resolution for image display can be mentioned as examples: VGA (640, 480); S-VGA (800, 600); XGA (1024, 768); APRC (1152, 900); S-XGA (1280, 1024); U-XGA (1600, 1200); HD-TV (1920, 1080); Q-XGA (2048, 1536); (1920, 1035); (720, 480); (1280, 960); and the like. However, they are not limited to those values.

In the embodiment of the invention, as each of the electron emitting devices constructing the electron emitting regions, a cold cathode field electron emitting device (hereinbelow, abbreviated to a "field emission device"), a metal/insulating film/metal type device (MIM device), and a surface conduction electron emitting device can be mentioned. As a flat panel display apparatus, a flat panel display apparatus having the cold cathode field electron emitting devices (cold cathode field electron emitting display apparatus), a flat panel display apparatus having the MIM devices, and a flat panel display apparatus having the surface conduction electron emitting devices can be mentioned.

Assuming that the flat panel display apparatus is the cold cathode field electron emitting display apparatus having the cold cathode field electron emitting devices (abbreviated to "field emission devices"), each field emission device includes:

(a) belt-shaped cathode electrodes formed on a supporting plate;

(b) an insulating layer formed over/on the supporting plate and the cathode electrodes;

(c) belt-shaped gate electrodes formed on the insulating layer;

(d) opening portions which are formed in the portions of the gate electrodes and the insulating layer locating in the overlapped regions where the cathode electrodes and the gate electrodes overlap and in which the cathode electrodes are exposed to the bottom portions; and (e) electron emitting portions which are formed on the cathode electrodes exposed to the bottom portions of the opening portions and in which the electron emission is controlled by applying voltages to the cathode electrodes and the gate electrodes.

The type of the field emission device is not particularly limited but there can be mentioned: a spindt type field emission device (a field emission device in which a conical electron emitting portion is formed on the cathode electrode locating in the bottom portion of the opening portion); and a flat type field emission device (a field emission device in which an almost plane electron emitting portion is formed on the cathode electrode locating in the bottom portion of the opening portion) In the cathode panel, the overlapped regions where the gate electrodes and the cathode electrodes overlap construct the electron emitting regions, the electron emitting regions are arranged in a 2-dimensional matrix form, and one or a plurality of field emission devices are provided in each electron emitting region.

In the cold cathode field electron emitting display apparatus, at the time of the actual displaying operation, a strong electric field caused by the voltages applied to the gate electrodes and the cathode electrodes is applied to the electron emitting portions, so that the electrons are emitted from the electron emitting portions by the quantum tunnel effect. The electrons are attracted to the anode panel by the anode electrode provided for the anode panel and collide with the phosphor regions. As a result of the collision of the electrons to the phosphor regions, the phosphor regions emit the light and can be recognized as an image.

In the cold cathode field electron emitting display apparatus, the cathode electrodes are connected to a cathode electrode control circuit, the gate electrodes are connected to a gate electrode control circuit, and the anode electrode are connected to an anode electrode control circuit, respectively. Those control circuits can be constructed by well-known circuits. At the time of the actual displaying operation or in the initial electron emitting state measuring step and the aging processing step, a voltage (anode voltage) $V_A$ which is applied from the anode electrode control circuit to the anode electrode is generally constant and can be set to, for example, 5 to 15 kvolts. Or, assuming that a distance between the anode panel and the cathode panel is equal to $d_0$ (where, 0.5 mm$\leqq d_0 \leqq$10 mm), it is preferable that a value of $V_A/d_0$ (unit: kvolts/mm) lies within a range from 0.5 or more to 20 or less, much preferably, a range from 1 or more to 10 or less, further preferably, a range from 4 or more to 8 or less. At the time of the actual displaying operation of the cold cathode field electron emitting display apparatus, for example, with respect to the voltage $V_{Col}$ which is applied to the cathode electrodes and the voltage $V_{Row}$ which is applied to the gate electrodes, a voltage modulating system or a pulse width modulating system can be used as a gradation control system.

The field emission device can be generally manufactured by the following method.

(1) A step of forming the cathode electrodes onto the supporting plate.

(2) A step of forming the insulating layer onto the whole surface (over/onto the supporting plate and the cathode electrodes).

(3) A step of forming the gate electrodes onto the insulating layer.

(4) A step of forming the opening portions into the portions of the gate electrodes and the insulating layer locating in the overlapped regions of the cathode electrodes and the gate electrodes and exposing the cathode electrodes to the bottom portions of the opening portions.

(5) A step of forming the electron emitting portions onto the cathode electrodes locating in the bottom portions of the opening portions.

Or, the field emission device can be also manufactured by the following method.

(1) A step of forming the cathode electrodes onto the supporting plate.

(2) A step of forming the electron emitting portions onto the cathode electrodes.

(3) A step of forming the insulating layer onto the whole surface (over/onto the supporting plate and the electron emitting portions or over/onto the supporting plate, the cathode electrodes, and the electron emitting portions).

(4) A step of forming the gate electrodes onto the insulating layer.

(5) A step of forming the opening portions into the portions of the gate electrodes and the insulating layer locating in the overlapped regions of the cathode electrodes and the gate electrodes and exposing the electron emitting portions to the bottom portions of the opening portions.

In the embodiment of the invention, in the case where a focusing electrode is provided, it is possible to use a structure in which an interlayer insulating layer is further formed on/over the gate electrode and the insulating layer and the focusing electrode is formed on the interlayer insulating layer or a structure in which the focusing electrode is formed over the gate electrode. The focusing electrode is an electrode in which a trajectory of the emission electrons which are emitted from the opening portion and progress toward the anode electrode is focused, thereby enabling the luminance to be improved and enabling the optical crosstalk between the adjacent pixels to be prevented. The focusing electrode is particularly effective in the cold cathode field electron emitting display apparatus of what is called a high voltage type in which a potential difference between the anode electrode and the cathode electrode is on the order of a few kilovolts or more and a distance between the anode electrode and the cathode electrode is relatively long. A negative voltage (for example, 0 volt) is relatively applied to the focusing electrode from a focusing electrode control circuit. It is not always necessary that the focusing electrode is individually formed so as to surround each of the electron emitting portions or the electron emitting regions provided in the overlapped regions where the cathode electrodes and the gate electrodes overlap. For example, the focusing electrodes may be provided so as to extend along a predetermined arranging direction of the electron emitting portions or the electron emitting regions or it is also possible to use a construction in which all of the electron emitting portions or the electron emitting regions are surrounded by one focusing electrode (that is, the focusing electrodes may be formed so as to have a structure of one thin sheet with which the whole valid region is covered). Thus, a common focusing effect can be exerted on a plurality of electron emitting portions or electron emitting regions. Opening portions (third opening portions) are formed in the focusing electrode and the interlayer insulating layer.

The valid region is a center display region which performs the display function as a practical function as a flat panel display apparatus. The invalid region is located outside of the valid region and surrounds the valid region in a picture frame shape.

As constructing materials of the cathode electrode, gate electrode, and focusing electrode, for example, the following materials can be mentioned: various kinds of metals containing metals such as chromium Cr, aluminum Al, tungsten W, niobium Nb, tantalum Ta, molybdenum Mo, copper Cu, gold Au, silver Ag, titanium Ti, nickel Ni, cobalt Co, zirconium Zr, iron Fe, platinum Pt, zinc Zn, and the like; alloys (for example, MoW) or compounds (for example, TiW, a nitride such as TiN or WN, and silicide such as $WSi_2$, $MoSi_2$, $TiSi_2$, or $TaSi_2$) containing those metal elements; a semiconductor such as silicon Si; a thin carbon film such as diamond; and a conductive metal oxide such as ITO (indium oxide-tin), indium oxide, or zinc oxide. The gate electrode, cathode electrode, and focusing electrode may be formed as a single layer structure or a laminated structure of those materials. As a forming method of those electrodes, for example, the following methods can be mentioned: a vacuum evaporation depositing method such as electron beam evaporation depositing method or thermal filament evaporation depositing method; physical vapor phase growing methods (PVD methods) such as sputtering method, ion plating method, and laser ablation method; various chemical vapor phase growing methods (CVD methods); a screen printing method; an ink jet printing method; a metal mask printing method; a plating method (an electroplating method and an electroless plating method); a lift-off method; a sol-gel method; and the like. Combinations of those methods and an etching method can be also mentioned. By properly selecting the forming method, the patterned belt-shaped cathode electrode, gate electrode, and focusing electrode can be also directly formed.

In the spindt type field emission device, as a material constructing the electron emitting portion, there can be mentioned at least one kind of materials selected from a group including molybdenum, a molybdenum alloy, tungsten, a tungsten alloy, titanium, a titanium alloy, niobium, a niobium alloy, tantalum, a tantalum alloy, chromium, a chromium alloy, and silicon containing impurities (polysilicon or amorphous silicon). The electron emitting portion of the spindt type field emission device can be formed by the various PVD methods such as sputtering method and vacuum evaporation depositing method or by the various CVD methods.

In the flat type field emission device, as a material constructing the electron emitting portion, it is preferable that the electron emitting portion is made of a material whose work function Φ is smaller than that of the material constructing the cathode electrode. It is sufficient that the material to be selected is decided on the basis of the work function of the material constructing the cathode electrode, the potential difference between the gate electrode and the cathode electrode, a magnitude of an emission electron current density which is required, and the like. Or, the material constructing the electron emitting portion may be properly selected from such materials that a secondary electron gain δ of such a material is larger than that of the conductive material constructing the cathode electrode. In the flat type field emission device, as a particularly preferable constructing material of the electron emitting portion, the following materials can be mentioned: carbon, more specifically speaking, amorphous diamond or graphite; a carbon-nanotube structure (carbon-nanotube and/or graphite-nanofiber); ZnO whiskers; MgO whiskers; $SnO_2$ whiskers; MnO whiskers; $Y_2O_3$ whiskers; NiO whiskers; ITO whiskers; $In_2O_3$ whiskers; and $Al_2O_3$ whiskers. It is not always necessary that the material constructing the electron emitting portion has a conductivity.

A plane shape (shape which is obtained when the opening portion is cut at a virtual plane which is parallel with the surface of the supporting plate) of the first opening portion (opening portion formed in the gate electrode) or the second opening portion (opening portion formed in the insulating layer) can be set to an arbitrary shape such as circle, ellipse, rectangle, polygon, rectangle with rounded sides, polygon with rounded sides, or the like. The first opening portion can be formed by, for example, an anisotropic etching, an isotropic etching, or a combination of the anisotropic etching and the isotropic etching, or the first opening portion can be also directly formed in dependence on the forming method of the gate electrode. The second opening portion can be also formed by, for example, the anisotropic etching, the isotropic etching, or the combination of the anisotropic etching and the isotropic etching. The third opening portions formed in the focusing electrode and the interlayer insulating layer can be also formed by a similar method.

In the field emission device, although depending on the structure of the field emission device, one electron emitting portion may exist in one opening portion, a plurality of electron emitting portions may exist in one opening portion, or it is also possible to use a structure in which a plurality of first opening portions are formed in the gate electrode, one second opening portion communicated with the first opening portions is formed in the insulating layer, and one or a plurality of electron emitting portions exist in one second opening portion formed in the insulating layer.

In the field emission device, a thin resistor film may be formed between the cathode electrode and the electron emitting portion. By forming the thin resistor film, the operation stability of the field emission device, uniformity of electron emitting characteristics, and suppression of a leak current between the cathode electrode and the gate electrode can be realized. As a material constructing the thin resistor film, for example, the following materials can be mentioned: a carbon system resistor material such as silicon carbide SiC or SiCN; a semiconductor resistor material such as SiN or amorphous silicon; a metal oxide having a high melting point such as ruthenium oxide $RuO_2$ or tantalum oxide; and a metal nitride having a high melting point such as tantalum nitride. As a forming method of the thin resistor film, for example, the sputtering method, various CVD methods, and the screen printing method can be mentioned. It is sufficient that an electric resistance value per electron emitting portion is set to a value within a range about from $1\times10^5$ to $1\times10^{11}\Omega$, preferably, a range from a few MΩ to tens of gigaΩ.

As materials constructing the insulating layer and the interlayer insulating layer, the following materials can be solely used or may be properly combined and used: an $SiO_2$ system material such as $SiO_2$, BPSG, PSG, BSG, AsSG, PbSG, SiON, SOG (spin-on glass), glass having a low melting point, or glass paste; an SiN system material; and an insulating resin such as polyimide. The insulating layer and the interlayer insulating layer can be formed by using well-known processes such as various CVD methods, coating method, sputtering method, and screen printing method.

In the flat panel display apparatus, as constructional examples of the anode electrode and the phosphor region, the following constructions can be mentioned.

(1) Construction in which the anode electrode is formed onto the substrate and the phosphor region is formed onto the anode electrode.

(2) Construction in which the phosphor region is formed onto the substrate and the anode electrode is formed onto the phosphor region.

In the construction of (1), what is called a metal-backed film which is conducting to the anode electrode may be formed onto the phosphor region.

In the construction of (2), the metal-backed film may be formed onto the anode electrode. The metal-backed film can be also used in common as an anode electrode.

The anode electrode may be formed by one anode electrode as a whole or can be also formed by a plurality of anode electrode units. In the latter case, it is preferable that one anode electrode unit is electrically connected to another anode electrode unit by an anode electrode resistor layer. As a material constructing the anode electrode resistor layer, for example, the following materials can be mentioned: a carbon system material such as carbon, silicon carbide SiC, or SiCN; an SiN system material; a metal oxide having a high melting point and a metal nitride having a high melting point such as ruthenium oxide $RuO_2$, tantalum oxide, tantalum nitride, chromium oxide, and titanium oxide; a semiconductor material such as amorphous silicon; and ITO. A desired stable sheet resistance value can be also realized by a combination of a plurality of thin films obtained by laminating a thin carbon film having a small resistance value onto an SiC resistor film. As a sheet resistance value of the anode electrode resistor layer, for example, $1\times10^{-1}\Omega/\square$ to $1\times10^{10}\Omega/\square$, preferably, $1\times10^3\Omega/\square$ to $1\times10^8\Omega/\square$ can be mentioned. It is sufficient that the number [UN] of anode electrode units is equal to 2 or more. For example, assuming that the total number of columns of the phosphor regions arranged on a straight line is equal to [un], [UN]=[un] or [un]=u·[UN] (where, u is an integer of 2 or more; preferably, $10\leqq u\leqq100$, much preferably, $20\leqq u\leqq50$). The value of u can be set to a number obtained by adding 1 to the number of spacers arranged at regular intervals, a number which coincides with the number of pixels or the number of subpixels, or an integral submultiple of the number of pixels or the number of subpixels. A size of each anode electrode unit may be identical irrespective of the positions of the anode electrode units or can be also made different depending on the positions of the anode electrode units. The anode electrode resistor layer may be formed onto one anode electrode as a whole. In place of forming the anode electrode onto almost the whole surface of the valid region as mentioned above, if the anode electrode is formed by being divided into the anode electrode units each having a smaller area, an electrostatic capacitance between the anode electrode unit and the electron emitting region can be reduced. Thus, the generation of a discharge can be reduced and the occurrence of damages of the anode electrode and the electron emitting region due to the discharge can be effectively reduced.

In the case where the anode electrode is constructed by the anode electrode units and partition walls (which will be described hereinafter) have been formed, the anode electrode units can be formed in such a manner that each anode electrode unit is formed from an upper surface of each phosphor region toward a side surface of the partition wall. The anode electrode units can be also formed in such a manner that each anode electrode unit is formed from the upper surface of each phosphor region toward the midway of the side surface of the partition wall.

It is sufficient to form the anode electrode (including the anode electrode units) by using a conductive material layer. As a forming method of the conductive material layer, for example, the following methods can be mentioned: a vacuum evaporation depositing method such as electron beam evaporation depositing method or thermal filament evaporation depositing method; various PVD methods such as sputtering method, ion plating method, and laser ablation method; various CVD methods; various printing methods including a screen printing method; a metal mask printing method; a lift-off method; a sol-gel method; and the like. That is, the conductive material layer is formed and pattered on the basis of a lithography technique and an etching technique, so that the anode electrode can be formed. Or, the anode electrode can be also obtained by forming a conductive material through a mask or screen having the pattern of the anode electrode on the basis of the various PVD methods or various printing methods. The anode electrode resistor layer can be also formed by a method which is analogous or similar to that of the anode electrode. That is, the anode electrode resistor layer is made of the resistor material and the anode electrode resistor layer may be patterned on the basis of the lithography technique and the etching technique, or the anode electrode resistor layer can be also obtained by forming the resistor material through the mask or screen having the pattern of the anode electrode resistor layer on the basis of the various PVD methods or various printing methods. As a mean thickness of the anode electrode on the substrate (or over the substrate) (in the case where the partition walls are provided as will be explained hereinafter, a mean thickness of the anode electrode on the top faces of the partition walls), for example, a value within a range from $3\times10^{-8}$ m (30 nm) to $1\times10^{-6}$ m (1 μm), preferably, a range from $5\times10^{-8}$ m (50 nm) to $5\times10^{-7}$ m (0.5 μm) can be mentioned.

As a constructing material of the anode electrode, for example, the following materials can be mentioned: metals such as aluminum Al, molybdenum Mo, chromium Cr, tungsten W, niobium Nb, tantalum Ta, gold Au, silver Ag, titanium Ti, cobalt Co, zirconium Zr, iron Fe, platinum Pt, zinc Zn, and the like; alloys or compounds (for example, a nitride such as TiN, and silicide such as $WSi_2$, $MoSi_2$, $TiSi_2$, or $TaSi_2$) containing those metal elements; a semiconductor such as silicon Si; a thin carbon film such as diamond or graphite; and a conductive metal oxide such as ITO (indium oxide-tin), indium oxide, or zinc oxide. In the case of forming the anode electrode resistor layer, it is preferable that the anode electrode is made of a conductive material which does not change the electric resistance value of the anode electrode resistor layer. For example, if the anode electrode resistor layer is made of silicon carbide SiC, it is preferable that the anode electrode is made of molybdenum Mo or aluminum Al.

The phosphor region may be formed by phosphor particles of monochrome or phosphor particles of three primary colors. A layout pattern of the phosphor regions is, for example, a dot-like pattern. Specifically speaking, when the flat panel display apparatus performs a color display, a delta layout, a stripe layout, a diagonal layout, and a rectangular layout can be mentioned as an arrangement and a layout of the phosphor regions. That is, one column of the phosphor regions arranged on a straight line may be constructed by a column in which all of the regions are occupied by the red light emitting phosphor regions, a column in which all of the regions are occupied by the green light emitting phosphor regions, and a column in which all of the regions are occupied by the blue light emitting phosphor regions, or it may be constructed by a column in which the red light emitting phosphor region, green light emitting phosphor region, and blue light emitting phosphor region are sequentially arranged. It is now defined that the phosphor region is a region of the phosphor which forms one luminescent spot on the anode panel. One picture element (one pixel) is constructed by a set of one red light emitting phosphor region, one green light emitting phosphor region, and one blue light emitting phosphor region. One subpixel is constructed by one phosphor region (one red light emitting phosphor region, one green light emitting phosphor region, or one blue light emitting phosphor region). A gap between the adjacent phosphor regions may be filled with a light absorbing layer (black matrix) for the purpose of improving the contrast.

The phosphor region can be formed by a method whereby radiative crystal grain compounds adjusted from radiative crystal grain are used, for example, the whole surface is coated with the red photosensitive radiative crystal grain compound (red light emitting phosphor slurry) and this compound is exposed and developed, thereby forming the red light emitting phosphor region, subsequently, the whole surface is coated with the green photosensitive radiative crystal grain compound (green light emitting phosphor slurry) and this compound is exposed and developed, thereby forming the green light emitting phosphor region, and further, the whole surface is coated with the blue photosensitive radiative crystal grain compound (blue light emitting phosphor slurry) and this compound is exposed and developed, thereby forming the blue light emitting phosphor region. Or, each phosphor region may be formed by a screen printing method, an ink jet printing method, a float coating method, a sedimentation coating method, a phosphor film transfer method, or the like. Although a mean thickness of the phosphor region on the substrate is not limited, it is preferable to set the thickness to a value within a range of 3 μm to 20 μm, much preferably, a range of 5 μm to 10 μm. As a phosphor material constructing the radiative crystal grain, a proper material can be properly selected from the well-known phosphor materials in the related art and used. In the case of the color display, it is preferable to combine such a phosphor material that its color purity is close to three primary colors specified by the NTSC, a white balance at the time of mixing the three primary colors is obtained, an afterglow decay time is short, and afterglow decay times of the three primary colors are almost equal.

It is preferable that the light absorbing layer for absorbing the light from the phosphor region is formed between the adjacent phosphor regions or between the partition wall, which will be described hereinafter, and the substrate from a viewpoint of improving the contrast of the display image. The light absorbing layer functions as what is called a black matrix. As a material constructing the light absorbing layer, it is preferable to select the material which can absorb 90% or more of the light from the phosphor region. As such a material, for example, the following materials can be mentioned: carbon; a thin metal film (for example, chromium, nickel, aluminum, molybdenum, or the like, or their alloys); a metal oxide (for example, chromium oxide); a metal nitride (for example, chromium nitride); a heat resistant organic resin; a glass paste; a glass paste containing conductive particles such as black pigment or silver; and the like. Specifically speaking, for example, a photosensitive polyimide resin, a chromium oxide, and chromium oxide/chromium laminate film can be mentioned. In the chromium oxide/chromium laminate film, the chromium film is come into contact with the substrate. The light absorbing layer can be formed by a method which has properly been selected from the following methods in dependence on the materials which are used: a combination of the vacuum evaporation depositing method or the sputtering method and the etching method; a combination of the vacuum evaporation depositing method, sputtering method, or spin coating method and the lift-off method; various printing methods; lithography technique; and the like.

It is preferable to provide the partition walls in order to prevent such a phenomenon that the electron recoiled from the phosphor region or the secondary electron emitted from the phosphor region enters another phosphor region and what is called an optical crosstalk (color turbidity) occurs.

As a method of forming the partition walls, for example, a screen printing method, a dry film method, a photo sensing method, a casting method, and as and blast forming method can be mentioned. The screen printing method is a method whereby an opening has been formed in a portion of a screen corresponding to a portion where the partition wall should be formed, a partition wall forming material on the screen is allowed to pass through the opening by using a squeegee, a partition wall forming material layer is formed onto the substrate, and thereafter, the partition wall forming material layer is baked. The dry film method is a method whereby a photosensitive film is laminated onto the substrate, the photosensitive film in a partition wall forming scheduled portion is removed by exposure and development, and the partition wall forming material is buried into an opening formed by the removal and baked. The photosensitive film is burned and removed by the baking. The partition wall forming material buried in the opening remains and becomes the partition wall. The photosensing method is a method whereby a partition wall forming material layer having photosensitivity is formed onto the substrate and the partition wall forming material layer is patterned by exposure and development and, thereafter, baked (hardened). The casting method (emboss molding method) is a method whereby a partition wall forming material layer made of a paste-like organic material or inorganic material is extruded onto the substrate from a die (cast), thereby forming the partition wall forming material layer, and thereafter, the partition wall forming material layer is baked. The sand blast forming method is a method whereby a partition wall forming material layer is formed onto the substrate by using, for example, the screen printing method or metal mask printing method, a roll coater, a doctor blade, a nozzle emitting type coater, or the like and dried, thereafter, a portion of the partition wall forming material layer where the partition wall should be formed is coated with a mask layer, and subsequently, the exposed portion of the partition wall forming material layer is removed by a sand blast method. After the partition wall was formed, the partition wall top face can be also flattened by grinding the partition wall.

As a plane shape of the portion which surrounds the phosphor region in the partition wall (corresponding to an inside profile of a projection image of a side surface of the partition wall; a kind of opening region), for example, a rectangular shape, a circular shape, an elliptic shape, an oval shape, a triangular shape, a polygonal shape of a pentagon or more, a triangular shape with rounded sides, a rectangular shape with rounded sides, a polygon with rounded sides, or the like can be mentioned. A rectilinear shape (rod-like shape) extending in parallel with two sides of the phosphor region can be also mentioned. By arranging those plane shapes (plane shapes of the opening regions) in a 2-dimensional matrix form, the lattice-shaped partition walls are formed. As a layout in the 2-dimensional matrix form, for example, the plane shapes may be arranged like a pattern of two pairs of intersecting parallel lines or a zigzag pattern.

As a partition wall forming material, for example, a photosensitive polyimide resin, lead glass colored in black by a metal oxide such as cobalt oxide or the like, $SiO_2$, or a glass paste of a low melting point can be mentioned. A protecting layer (made of, for example, $SiO_2$, SiON, or AlN) adapted to prevent such a phenomenon that the electron beam collides with the partition wall and a gas is emitted from the partition wall may be formed on the surface (top face or side surface) of the partition wall.

In the case of joining the cathode panel and the anode panel in the peripheral edge portion, the joining can be performed by using an adhesive layer as a joint member or may be performed by using a joint member formed by an adhesive layer and a rod-shaped or frame-shaped frame body made of a rigid insulating material such as glass or ceramics. In the case of using the joint member formed by the frame body and the adhesive layer, by properly selecting a height of frame body, the facing distance between the cathode panel and the anode panel can be set to be longer than that in the case of using the joint member made of only the adhesive layer. As a constructing material of the adhesive layer, frit glass such as $B_2O_3$—PbO system frit glass or $SiO_2$—$B_2O_3$—PbO system frit glass is generally used. However, what is called a metal material of a low melting point of about 120 to 400° C. may be used. As such a low melting point metal material, for example, the following materials can be mentioned: In (indium: melting point of 157° C.); an alloy of a low melting point of an indium-gold system; a high temperature solder of a tin Sn system such as $Sn_{80}Ag_{20}$ (melting point of 220 to 370° C.) or $Sn_{95}Cu_5$ (melting point of 227 to 370° C.); a high temperature solder of a lead Pb system such as $Pb_{97.5}Ag_{2.5}$ (melting point of 304° C.), $Pb_{94.5}Ag_{5.5}$ (melting point of 304 to 365° C.), or $Pb_{97.5}Ag_{1.5}Sn_{1.0}$ (melting point of 309° C.); a high temperature solder of a zinc Zn system such as $Zn_{95}Al_5$ (melting point of 380° C.) or the like; a standard solder of a tin-lead system such as $Sn_5Pb_{95}$ (melting point of 300 to 314° C.) or $Sn_2Pb_{98}$ (melting point of 316 to 322° C.); and a brazing material such as $Au_{88}Ga_{12}$ (melting point of 381° C.) or the like (all of the above suffixes indicate atom %).

In the case of joining three members such as cathode panel, anode panel, and joint member, they may be simultaneously joined or either the cathode panel or the anode panel may be joined with the joint member at the first stage and the other one of the cathode panel and the anode panel may be joined with the joint member at the second stage. If the simultaneous joining of those three members or the joining at the second stage is executed in a high vacuum atmosphere, the space surrounded by the cathode panel, anode panel, and joint member enters a vacuum state simultaneously with the joining. Or, after completion of the joining of those three members, the inside of the space surrounded by the cathode panel, anode panel, and joint member can be also exhausted and set into the vacuum state. In the case of exhausting after the joining, a pressure of the atmosphere upon joining may be equal to either the atmospheric pressure or the reduced pressure. Although it is preferable that a gas forming the atmosphere is an inert gas containing a nitrogen gas or a gas (for example, Ar gas) belonging to Group 0 in a periodic table, the joining can be also performed in the atmosphere.

In the case of exhausting, the exhaustion can be executed through an exhaust pipe also called a tip pipe which has previously been connected to the cathode panel and/or the anode panel. Typically, the exhaust pipe is formed by a glass pipe or a hollow pipe made of a metal or an alloy [for example, an iron Fe alloy containing 42 weight % of nickel Ni or an iron Fe alloy containing 42 weight % of nickel Ni and 6 weight % of chromium Cr] each having a low coefficient of thermal expansion. By using the foregoing frit glass or metal material having the Low melting point, the exhaust pipe is joined to the circumference of a piercing portion provided in an invalid region of the cathode panel and/or the anode panel. After the inside of the space reached a predetermined vacuum degree, the exhaust pipe is fully sealed by a thermal fusion or by being bonded with a pressure. If the whole flat panel display apparatus is temporarily heated and, thereafter, its temperature is reduced prior to sealing, a residual gas can be emitted into the space and the residual gas can be removed out of the space by the exhaustion. Therefore, such a method is preferable.

The spacers of one column may be constructed by one spacer or by a plurality of spacers. The spacer can be made of, for example, ceramics or a glass material. In the case where the spacer is made of ceramics, for example, the following materials can be mentioned as ceramics: an aluminum silicate compound such as mullite; aluminum oxide such as alumina; barium titanate; lead zirconate titanate; zirconia (zirconium oxide); cordiolight; barium borosilicate; iron silicate; a glass ceramics material; materials obtained by respectively adding titanium oxide, chromium oxide, magnesium oxide, iron oxide, vanadium oxide, and nickel oxide to those materials; and the like. For example, the materials disclosed in Japanese Patent Application Laid-Open (translation version of PCT international publication) No. 2003-524280 and the like can be also used. As a glass material, for example, the following materials can be mentioned: glass of a high strain point; low-alkali glass; no-alkali glass; soda glass ($Na_2O.CaO.SiO_2$); borosilicate glass ($Na_2O.B_2O_3.SiO_2$); forsterite ($2MgO.SiO_2$); lead glass ($Na_2O.PbO.SiO_2$); and crystalline glass. It is preferable to remove projecting portions or the like by chamfering the edge portions of the spacer. It is sufficient that, for example, the spacer is sandwiched and fixed between the partition walls provided for the anode panel or, for example, spacer holding portions are formed to the anode panel and/or the cathode panel and the spacer is fixed by the spacer holding portions.

The spacer can be manufactured by, for example, the following method.

(a) Ceramics powder and conductivity applying material powder are used as a dispersoid, a binder is added, and a slurry for a green sheet is adjusted.

(b) The slurry for the green sheet is molded and the green sheet is obtained. After that, (c) the green sheet is baked.

After the green sheet baked product was cut, an antistatic film and a resistor film, which will be explained hereinafter, may be formed, or after the antistatic film and the resistor film were formed onto the green sheet baked product, the green sheet baked product can be also cut.

The foregoing ceramics can be mentioned as a material constructing the ceramics powder serving as a dispersoid of the slurry for the green sheet. The conductivity applying material serving as a dispersoid of the slurry for the green sheet does not always show the conductivity in the slurry for the green sheet. The conductivity applying material may be a material whose chemical compositions change upon baking the green sheet or a material whose chemical compositions are not changed by the baking. Specifically speaking, although the conductivity applying material in the green sheet is also baked by baking the green sheet, it is sufficient that the baked conductivity applying material shows the conductivity. As a conductivity applying material serving as a dispersoid of the slurry for the green sheet, for example, the following materials can be mentioned: a precious metal such as gold or platinum; a metal oxide such as molybdenum oxide, niobium oxide, tungsten oxide, or nickel oxide; a metal carbide such as titanium carbide, tungsten carbide, or nickel carbide; and a metal salt such as ammonium molybdate. Further, a mixture of those materials may be used. That is, the conductivity applying material can be made of a single kind of material or can be made of a plurality of kinds of materials. As a material constructing the binder which is added to the slurry for the green sheet, for example, an organic system binder material (for example, acrylic emulsion, polyvinyl alcohol (PVA), or polyethylene glycol), or an inorganic system binder material (for example, water glass) can be mentioned.

It is preferable that the antistatic film or the resistor film is formed on the side surfaces of the spacer. As a material constructing the antistatic film, it is preferable that its secondary electron emitting coefficient is close to 1. As a material constructing the antistatic film, a semiconductor of Si or Ge, a semimetal such as graphite, an oxide, a boride, a carbide, a sulfide, a nitride, and the like can be used. More specifically speaking, for example, the following materials can be mentioned: a compound containing a semimetal such as graphite and a semimetal element such as $MoSe_x$; oxide such as $CrO_x$, $NdO_x$, $CrAl_xO_y$, manganese oxide, $La_xBa_{2-x}CuO_4$, or $La_xY_{1-x}CrO_3$; boride such as $AlB_x$ or $TiB_x$; carbide such as SiC; sulfide such as $MoS_x$ or $WS_x$; a compound of tungsten nitride and germanium nitride; nitride such as BN, TiN, or AlN; and the like. Further, for instance, the materials and the like disclosed in Japanese Patent Application Laid-Open (translation version of PCT international publication) No. 2004-500688 and the like can be also used. As a material forming the resistor film, for example, ruthenium oxide $RuO_x$ or cermet can be mentioned. The film such as an antistatic film or the like formed on the surface of the spacer may be made of a single kind of material or can be also made of a plurality of kinds of materials. The film may have a single layer structure or a multilayer structure. The antistatic film can be also made of a mixture of (a first metal oxide, a second metal oxide). As a combination of (the first metal oxide, the second metal oxide), the following combination can be mentioned: (chromium oxide, titanium oxide); (chromium oxide, indium oxide); (manganese oxide, titanium oxide); (manganese oxide, indium oxide); (zinc oxide, titanium oxide); or (zinc oxide, indium oxide). The antistatic film and the like can be formed by the well-known methods such as various PVD methods such as sputtering method and vacuum evaporation depositing method and various CVD methods. The antistatic film and the like may be directly provided on the side surface portions of the spacer or, for example, an underfilm for improvement of adhesion or the like is formed on the spacer and the antistatic film and the like may be formed on the underfilm.

In the embodiments of the invention, the initial electron emitting state measuring step and the aging processing step are executed or only the aging processing step is executed. That is, in the invention, by executing the aging processing step, the electron emitting characteristics of the high electron emitting row are actively deteriorated more than the electron emitting characteristics of the low electron emitting row (there is a case where such a phenomenon is called "burning"), thereby uniforming the electron emitting characteristics in the electron emitting regions, setting the electron emitting characteristics in the electron emitting regions to desired electron emitting characteristics, or enabling the electron emitting characteristics to approach the desired electron emitting characteristics. In other words, for example, ununiformity of the electron emitting states in the electron emitting regions near the spacer that has been caused after completion of the manufacturing of the flat panel display apparatus is eliminated by using the "burning" which occurs by applying the high voltage to the electron emitting regions for a long time, or by using the "burning" which occurs by applying the high voltage to the electron emitting regions locating at the positions away from the spacer for a long time. Since a ratio of the deterioration is small, it does not exert an adverse influence on the actual displaying operation of the flat panel display apparatus.

As mentioned above, for example, the difference between the electron emitting state in the electron emitting region locating near the spacer and the electron emitting state in the electron emitting region which is not located near the spacer can be made to approach a desired state by the process prior to the factory shipping after completion of the manufacturing of the flat panel display apparatus, that is, before the full-dress actual displaying operation of the flat panel display apparatus. Therefore, by properly electrically controlling the electron emitting states in the electron emitting regions, the flat panel display apparatus having the high display quality can be provided. At the point of time of completion of the aging process, the electron emitting state after the aging process of the high electron emitting row or the low electron emitting row is set into such an electron emitting state that the aging change ratio of the electron emitting state at the time of the actual displaying operation in the flat panel display apparatus lies within the predetermined range, so that the aging change can occur in the emitting state of the electrons from the electron emitting region. However, a variation in aging change as a whole flat panel display apparatus can be reduced as much as possible.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENTS

The invention will be described hereinbelow on the basis of embodiments with reference to the drawings. Prior to explaining it, a common outline of flat panel display apparatuses in embodiments 1 to 5 will be described hereinbelow. The flat panel display apparatus in each of the embodiments 1 to 5 is a cold cathode field electron emitting display apparatus (hereinbelow, abbreviated to a display apparatus). In the display apparatus in each of the embodiments 1 to 5, the belt-shaped gate electrode (for example, scanning electrode) 13 extends in the row direction (X direction) and the belt-shaped cathode electrode (for example, data electrode) 11 extends in the column direction (Y direction).

Figure 7:
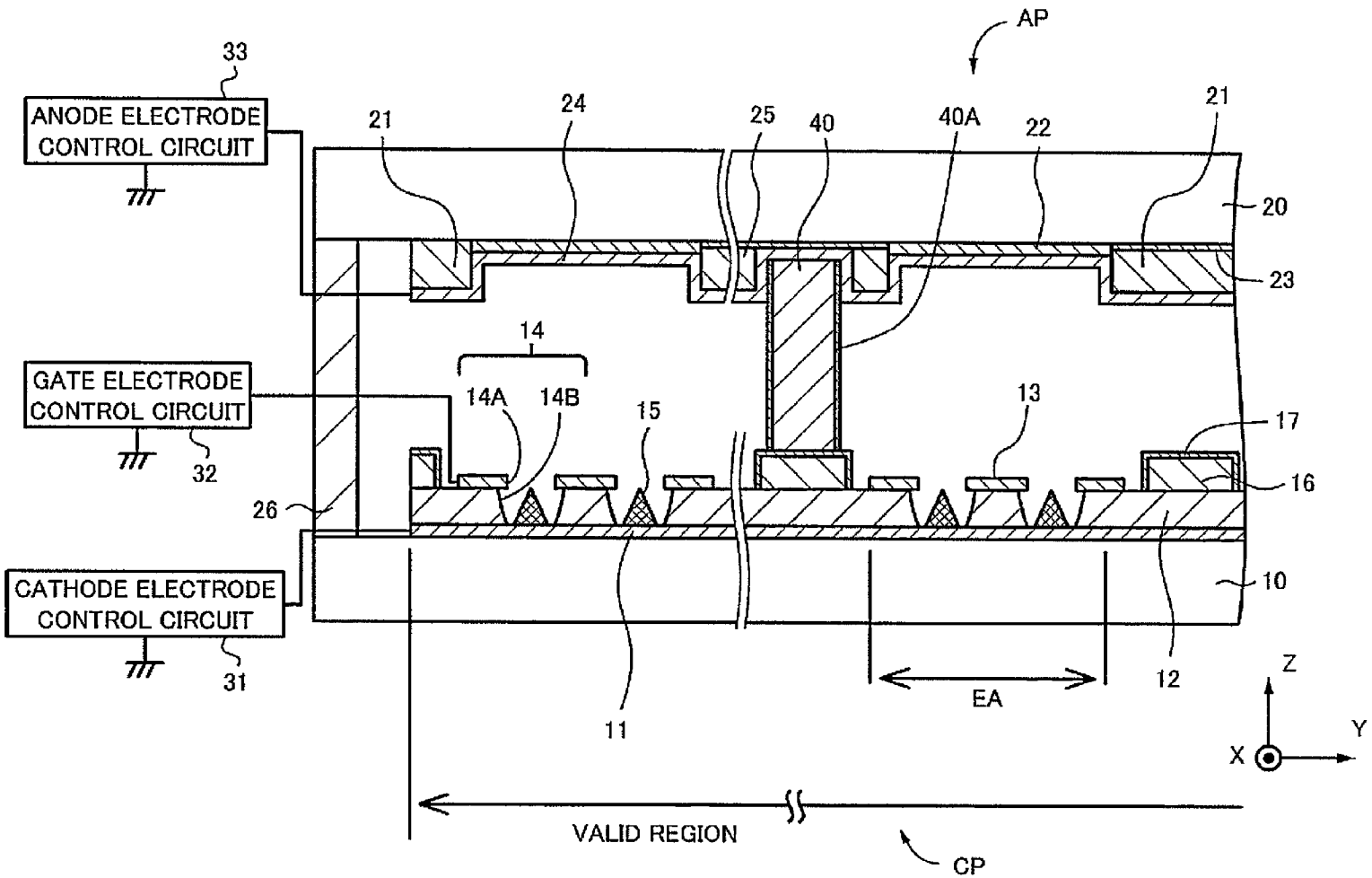
FIG. 7 shows a schematic diagram with a part cut away of a cold cathode field electron emitting display apparatus having spindt type cold cathode field emission devices as a flat panel display apparatus.

A schematic diagram with a part cut away of the display apparatus in each embodiment is similar to that illustrated in FIG. 7. A schematic exploded perspective view of a part of a cathode panel CP and a part of an anode panel AP at the time when the cathode panel CP and the anode panel AP are exploded is similar to that illustrated in FIG. 8. That is, in the display apparatus in the embodiment, the cathode panel CP having the electron emitting regions EA arranged on the supporting plate 10 along the row direction (X direction) and the column direction (Y direction) in a 2-dimensional matrix form and the anode panel AP having the phosphor regions 22 and the anode electrode 24 are joined in the peripheral portion. The spacers 40*a* rearranged along the row direction (X direction) between the cathode panel CP and the anode panel AP. The spacers 40 are held by the spacer holding portions 25. A space sandwiched between the cathode panel CP and the anode panel AP is held in a vacuum state.

The display apparatus in the embodiment has the valid region and the invalid region which surrounds the valid region. The valid region is a display region which is located at an almost center position and performs an actual image display function as a flat panel display apparatus. The valid region is surrounded by the invalid region which surrounds in a picture frame shape. A space sandwiched by the cathode panel CP, the anode panel AP, and the joint members 26 is held in a vacuum state (pressure: for example, $10^{-3}$ Pa or less). A piercing hole (not shown) for vacuum evacuation is formed in the invalid region of the cathode panel CP. An exhaust pipe (not shown) also called a tip pipe which is perfectly sealed after the vacuum evacuation is attached to the piercing hole.

In the embodiment, the field emission device forming the electron emitting region is constructed by, for example, a spindt type field emission device. The spindt type field emission device is constructed by:

(a) the belt-shaped cathode electrodes 11 formed on the supporting plate 10;

(b) the insulating layer 12 formed over/on the supporting plate 10 and the cathode electrodes 11;

(c) the belt-shaped gate electrodes 13 formed on the insulating layer 12;

(d) the opening portions 14 which are formed in the portions of the gate electrodes 13 and the insulating layer 12 locating in the overlapped regions where the cathode electrodes 11 and the gate electrodes 13 overlap and in which the cathode electrodes 11 are exposed to the bottom portions (the first opening portions 14A formed in the gate electrodes 13 and the second opening portions 14B formed in the insulating layer 12); and (e) the electron emitting portions 15 which are formed on the cathode electrodes 11 exposed to the bottom portions of the opening portions 14 and in which the electron emission is controlled by applying the voltages to the cathode electrodes 11 and the gate electrodes 13.

The electron emitting portion 15 has a conical shape. The interlayer insulating layer 16 is formed on the insulating layer 12. The focusing electrode 17 is formed on the interlayer insulating layer 16.

In the display apparatus in the embodiment, the cathode electrode 11 and the gate electrode 13 are respectively formed in a belt shape in such directions (the column direction and the row direction) that the projection images of both electrodes 11 and 13 cross perpendicularly. A plurality of field emission devices are provided in the overlapped region where the projection images of both electrodes overlap (such a region corresponds to a region of one subpicture element (subpixel) and is the electron emitting region EA). For simplicity of the drawing, two electron emitting portions 15 are illustrated in each electron emitting region EA in FIG. 7. The electron emitting regions EA are ordinarily arranged in the valid region (the region which functions as a practical display portion) of the cathode panel CP in a 2-dimensional matrix form as mentioned above.

The anode panel AP includes: the substrate 20; the phosphor regions 22 which are formed on the substrate 20 and have the predetermined pattern; and the anode electrode 24 formed on the phosphor regions 22. One subpixel is constructed by the electron emitting region EA and the phosphor region 22 on the anode panel side which faces the electron emitting region EA.

Figure 8:
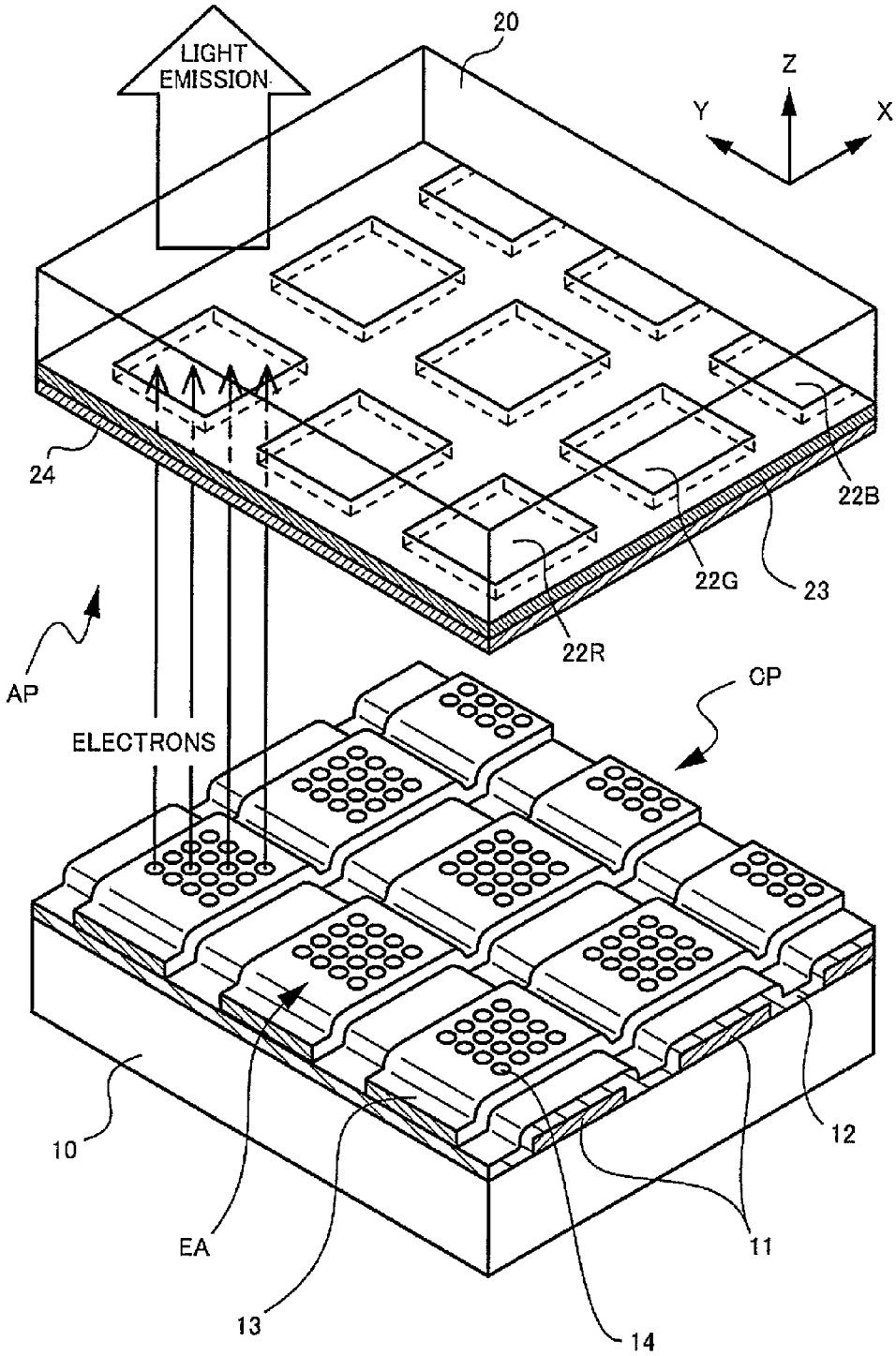
FIG. 8 is a schematic exploded perspective view of a part of a cathode panel and a part of an anode panel at the time when the cathode panel and the anode panel constructing the cold cathode field electron emitting display apparatus shown in FIG. 7 are exploded.
Figure 9A:
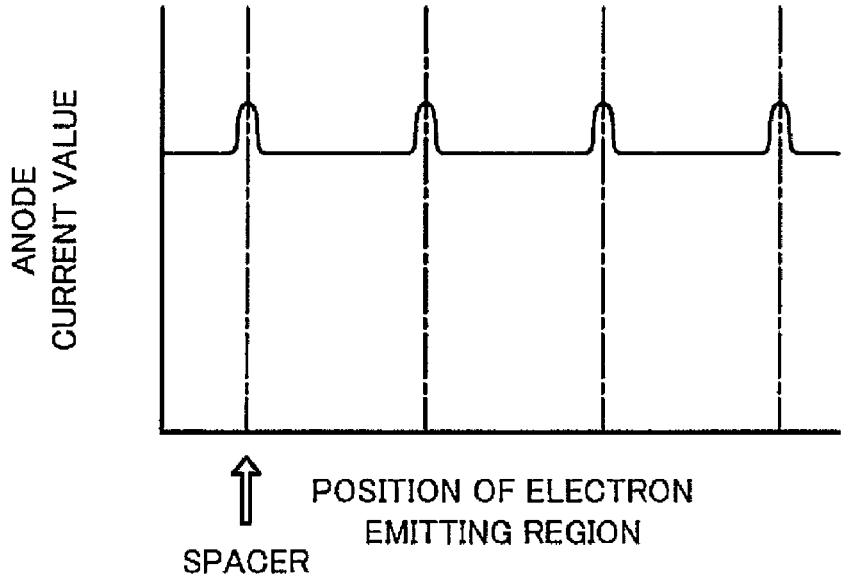
FIGS. 9A and 9B are graphs each schematically showing a difference caused between the electron emitting state in the electron emitting region locating near a spacer and the electron emitting state in the electron emitting region which is not located near the spacer in the flat panel display apparatus.
Figure 9B:
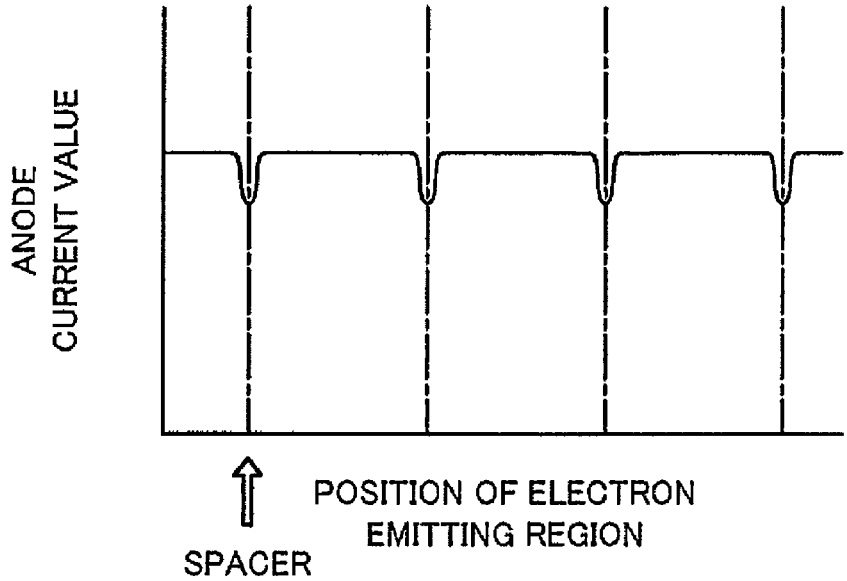
Figure 10:
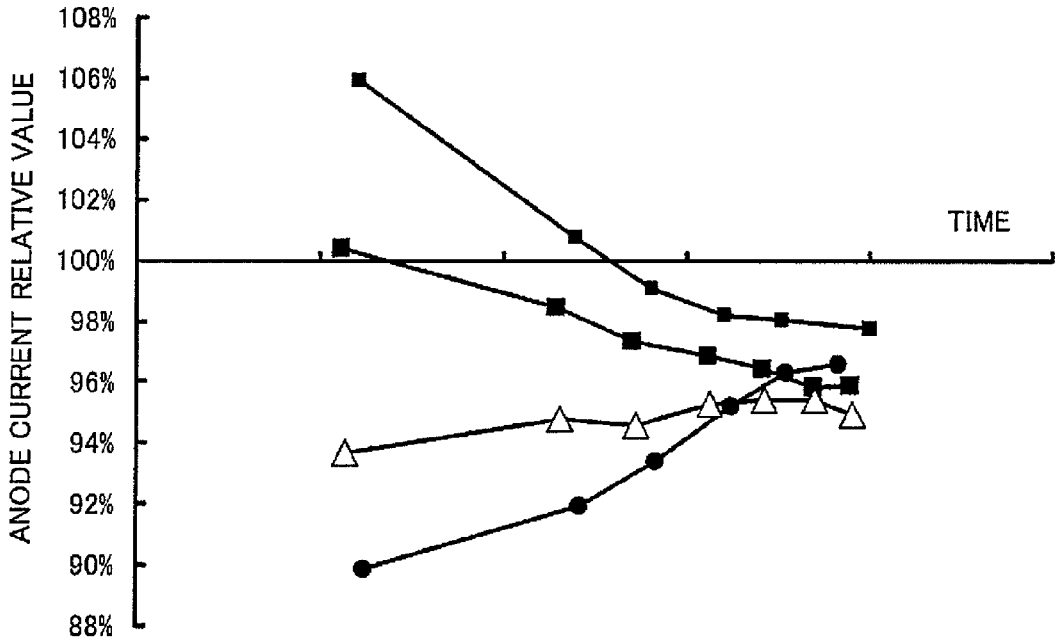
FIG. 10 is a graph for explaining that an aging change occurs in the emitting state of electrons from the electron emitting region.
Figure 11A:
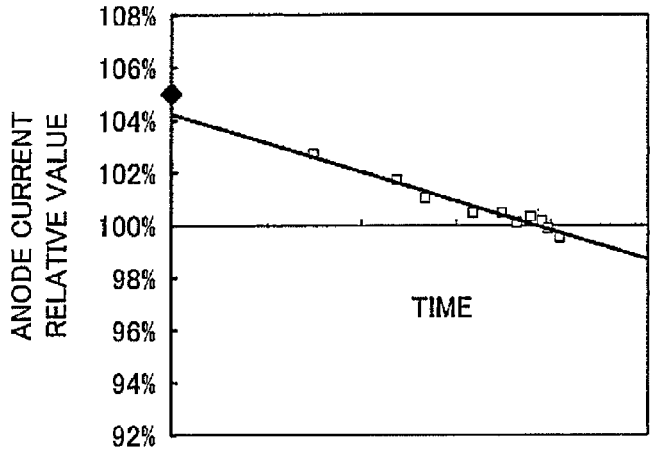
FIGS. 11A, 11B, and 11C are graphs each for explaining that the aging change occurs in the emitting state of the electrons from the electron emitting region.
Figure 11B:
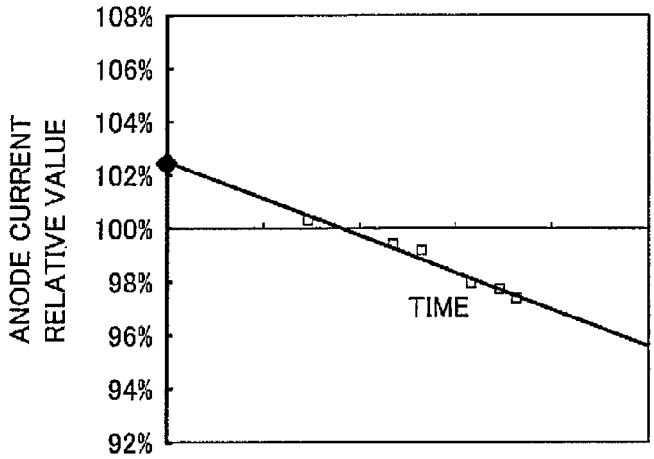
Figure 11C:
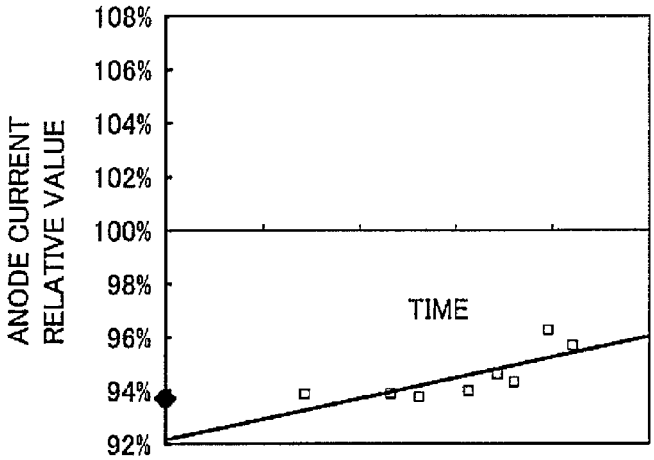

The subpixels are arranged in the valid region on the order of, for example, hundred thousands of to millions of subpixels. The light absorbing layer (black matrix) 23 is formed on the substrate 20 between the phosphor regions 22 in order to prevent the occurrence of the color turbidity of the display image and the optical crosstalk. The anode electrode 24 is made of aluminum Al having a thickness of about 0.3 μm, is one sheet-like thin member with which the valid region is covered, and is provided in a state where the phosphor regions 22 are covered. In FIG. 8, the partition walls, the spacer, and the spacer holding portions are omitted. In the case of the display apparatus of the color display, one pixel is constructed by a set of one red light emitting phosphor region 22R, one green light emitting phosphor region 22G, and one blue light emitting phosphor region 22B. The lattice-shaped partition walls 21 which surround each phosphor region 22 are formed on the substrate 20. Each phosphor region 22 is surrounded by the partition walls 21. A plane shape of the portion surrounding the phosphor region 22 in the lattice-shaped partition walls 21 (corresponding to an inside profile of a projection image of a side surface of the partition wall; a kind of opening region) is a rectangular shape (rectangle). Those plane shapes (plane shapes of the opening regions) are arranged in a 2-dimensional matrix form (more specifically speaking, a pattern of two pairs of intersecting parallel lines) and the lattice-shaped partition walls 21 are formed.

In the display apparatus in the embodiment, a plurality of columns of flat-shaped spacers 40 extending in the row direction (X direction) are arranged between the cathode CP and the anode panel AP. Tens of to hundreds of gate electrodes 13 are sandwiched between the spacers 40. The spacer 40 is made of, for example, alumina $Al_2O_3$ and a resistance value between the top face and the bottom surface of the spacer 40 is equal to about $1\times10^{10}\Omega$ (about 10 GΩ). The antistatic film 40A made of chromium oxide $CrO_x$ having a thickness of 4 nm is formed on the side surface of the spacer 40 on the basis of, for example, an RF sputtering method. Since a secondary electron emitting coefficient of chromium oxide is relatively small, chromium oxide is a very preferable material as an antistatic film under such a condition that the spacer 40 is charged to a positive polarity.

In the display apparatus in the embodiment, the cathode electrode 11 is connected to the cathode electrode control circuit 31. The gate electrode 13 is connected to the gate electrode control circuit 32. When the focusing electrode is provided, the focusing electrode is connected to a focusing electrode control circuit (not shown). The anode electrode 24 is connected to the anode electrode control circuit 33. At the time of the actual displaying operation of the display apparatus or in the initial electron emitting state measuring step and the aging processing step, an anode voltage $V_A$ which is applied to the anode electrode 24 from the anode electrode control circuit 33 is ordinarily constant and can be set to a value of, for example, 5 to 15 kvolts, specifically speaking, for example, 9 kvolts (for example, $d_0$=2.0 mm). At the time of the actual displaying operation of the display apparatus, with respect to a voltage $V_C$ which is applied to the cathode electrode 11 and a voltage $V_G$ which is applied to the gate electrode 13, any one of the following systems can be used.

(1) A system in which the voltage $V_C$ which is applied to the cathode electrode 11 is set to be constant and the voltage $V_G$ which is applied to the gate electrode 13 is changed.

(2) A system in which the voltage $V_C$ which is applied to the cathode electrode 11 is changed and the voltage $V_G$ which is applied to the gate electrode 13 is set to be constant.

(3) A system in which the voltage $V_C$ which is applied to the cathode electrode 11 is changed and the voltage $V_G$ which is applied to the gate electrode 13 is also changed.

However, in the display apparatus in the embodiment, the system of (2) is used.

That is, at the time of the actual displaying operation of the display apparatus, the negative voltage $V_C$ is relatively applied to the cathode electrode 11 from the cathode electrode control circuit 31 and the positive voltage $V_G$ is relatively applied to the gate electrode 13 from the gate electrode control circuit 32. If the focusing electrode is provided, a voltage of, for example, 0 volt is applied to the focusing electrode from the focusing electrode control circuit and the positive voltage (anode voltage $V_A$) which is further higher than the voltage of the gate electrode 13 is applied to the anode electrode 24 from the anode electrode control circuit 33.

In the display apparatus, in the case of displaying the image by the line-sequential driving system or in the initial electron emitting state measuring step and the aging processing step, for example, the video signal is inputted to the cathode electrode 11 from the cathode electrode control circuit 31 and the scan signal is inputted to the gate electrode 13 from the gate electrode control circuit 32. When the image is displayed, if the cathode electrode 11 is assumed to be the scanning electrode and the gate electrode 13 is assumed to be the data electrode, it is sufficient that the scan signal is inputted to the cathode electrode 11 from the cathode electrode control circuit 31 and the video signal is inputted to the gate electrode 13 from the gate electrode control circuit 32. The electrons are emitted from the electron emitting portions 15 on the basis of the quantum tunnel effect by the electric field that is caused when the voltages are applied between the cathode electrode 11 and the gate electrode 13. The emitted electrons are attracted to the anode electrode 24, pass through the anode electrode 24, and collide with the phosphor region 22. Thus, the phosphor region 22 is excited and emits the light and a desired image can be obtained. That is, the operation of the display apparatus is fundamentally controlled by the voltage $V_G$ which is applied to the gate electrode 13 and the voltage $V_C$ which is applied to the cathode electrode 11. The cathode electrode 11 is driven by a cathode electrode operating driver and the gate electrode 13 is driven by a gate electrode operating driver. The cathode electrode control circuit 31, gate electrode control circuit 32, anode electrode control circuit 33, and operating drivers can be constructed by the well-known circuits.

A processing method of the flat panel display apparatus of the invention will be described hereinbelow on the basis of embodiments. An embodiment 1 relates to the processing method of the flat panel display apparatus according to each of the first aspect (that is, first construction) and the second aspect of the invention. A case where there is hardly any variation in each of the initial electron emitting states in the high electron emitting row and the initial electron emitting states in the low electron emitting row which were obtained in the initial electron emitting state measuring step will be described. An embodiment 2 relates to the processing method of the flat panel display apparatus according to each of the first aspect (that is, first construction) and the second aspect of the invention. A case where there is a variation in the initial electron emitting states in the high electron emitting row which were obtained in the initial electron emitting state measuring step will be described. Further, an embodiment 3 relates to the processing method of the flat panel display apparatus according to each of the first aspect (that is, second construction) and the second aspect of the invention. A case where there is hardly any variation in each of the initial electron emitting states in the high electron emitting row and the initial electron emitting states in the low electron emitting row which were obtained in the initial electron emitting state measuring step will be described. An embodiment 4 relates to the processing method of the flat panel display apparatus according to the second aspect of the invention. A case where there is hardly any variation in each of the initial electron emitting states in the high electron emitting row and the initial electron emitting states in the low electron emitting row which were obtained in the initial electron emitting state measuring step will be described. Further, in an embodiment 5, the processing method of the flat panel display apparatus according to the third aspect of the invention will be described. It is sufficient that which one of the embodiments 1, 2, 3, and 4 should be applied is determined by a method whereby results of the initial electron emitting state measuring step are analyzed and a degree of the variation in the initial electron emitting states in the high electron emitting row and a degree of the variation in the initial electron emitting states in the low electron emitting row are properly discriminated in the control circuits provided in the display apparatus.

Embodiment 1

The embodiment 1 relates to the processing method of the flat panel display apparatus according to each of the first aspect and the second aspect of the invention, and more specifically speaking, it relates to the first construction.

That is, in the processing method of the flat panel display apparatus according to each of the embodiment 1 or embodiments 2 to 4, which will be explained hereinafter, first, the initial electron emitting state measuring step wherein a predetermined voltage is applied to each electron emitting region EA to thereby allow the electrons to be emitted from each electron emitting region EA, and in a predetermined row, the initial electron emitting states in the electron emitting regions EA are measured is executed.

In the embodiment 1 or the embodiments 2 to 4, which will be explained hereinafter, the line-sequential driving system is used in the initial electron emitting state measuring step. Specifically speaking, assuming that the number of rows is equal to N and the number of columns is equal to M, the operation for applying the same row voltage $V_{Ini\text{-}Row}$ to the M electron emitting regions EA arranged on each row and, at the same time, applying the same column voltage $V_{Ini\text{-}Col}$ to the M electron emitting regions EA arranged on each row is sequentially executed with respect to the first to Nth rows. Each of the row voltage $V_{Ini\text{-}Row}$ and the column voltage $V_{Ini\text{-}Col}$ is set to the voltage corresponding to the maximum drive signal at the time of the actual operation of the display apparatus. Further, the predetermined row is assumed to be all rows (N rows, N gate electrodes 13) constructing the display apparatus. The initial electron emitting states in the electron emitting regions EA are measured by a method whereby the anode current flowing between the electron emitting region EA and the anode electrode by the electrons emitted from the electron emitting region EA is measured.

Figure 1A:
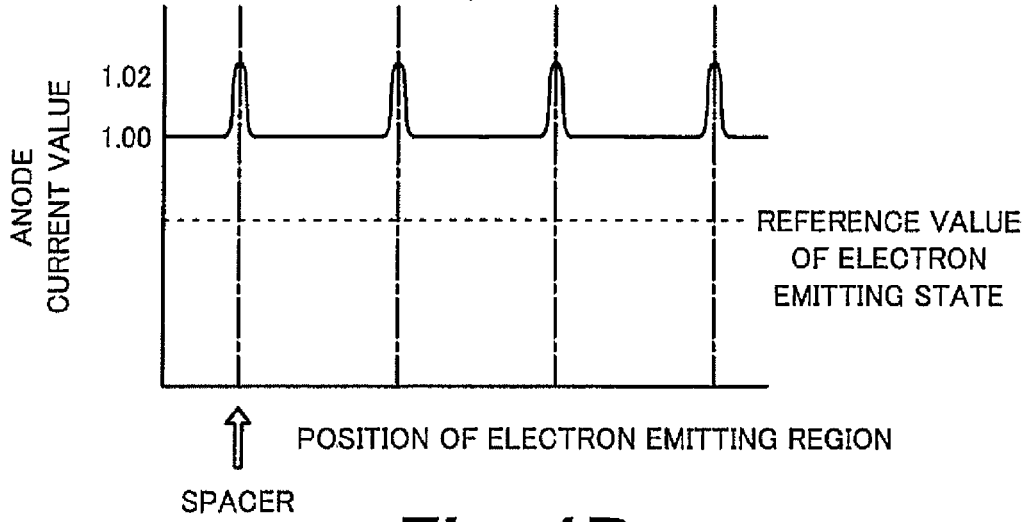
FIGS. 1A, 1B, and 1C are graphs each schematically showing measurement results of an initial electron emitting state in an initial electron emitting state measuring step, measurement results of an electron emitting state after completion of an aging processing step, and a voltage which is applied to an electron emitting region which were obtained in an embodiment 1.

The measurement results of the initial electron emitting states in the initial electron emitting state measuring step obtained in the embodiment 1 are schematically shown in FIG. 1A. In the embodiment 1, there is hardly any variation in each of the initial electron emitting states in the high electron emitting row and the initial electron emitting states in the low electron emitting row which were obtained in the initial electron emitting state measuring step. The measurement values of the initial electron emitting states are anode current values.

Figure 1B:
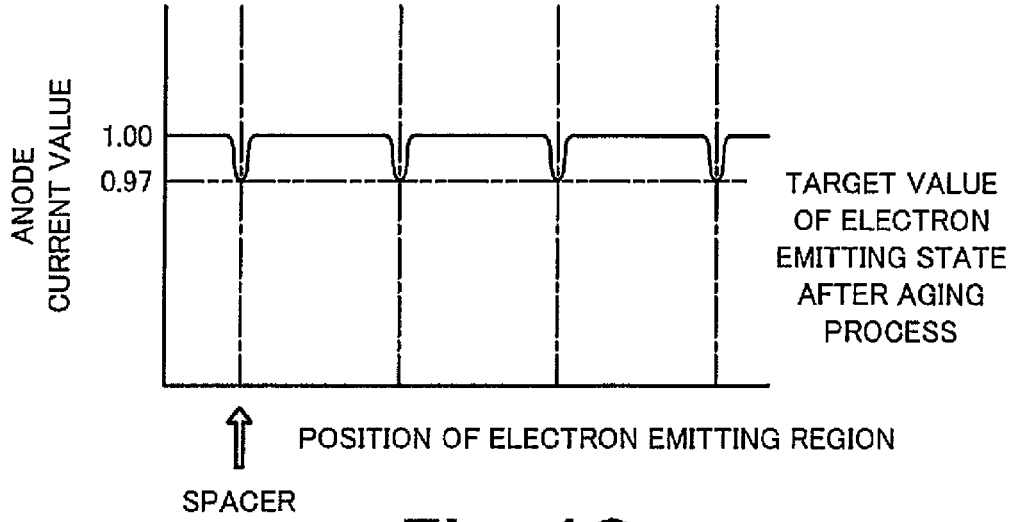

In FIGS. 1A and 1B or in FIGS. 2A, 2B, 3A, 3B, 4A, 4B, 5A, and 5B, which will be explained hereinafter, the anode current value shown on an axis of ordinate is a value of the anode current flowing between the electron emitting region EA and the anode electrode 24 by the electrons emitted from the electron emitting region EA (M regions) which occupy one row, and an axis of abscissa indicates the positions of the electron emitting regions arranged along the column direction (Y direction). In the diagrams, an alternate long and short dash line extending vertically indicates positions where the spacers 40 are arranged. A broken line extending laterally indicates a reference value of the electron emitting state. An alternate long and two short dashes line indicates a target value of the electron emitting state obtained after the aging process.

In the embodiment 1, an amount of electrons emitted from the electron emitting region EA locating near the spacer 40 is larger than an amount of electrons emitted from the electron emitting region EA locating at a position away from the spacer 40. That is, the electron emitting region EA locating near the spacer 40 shows the high initial electron emitting state and the electron emitting region EA locating at the position away from the spacer 40 shows the low initial electron emitting state. The rows on which the electron emitting regions EA showing the low initial electron emitting state occupy the majority rows. That is, the embodiment 1 corresponds to the foregoing case A. The anode current value in the low electron emitting row is assumed to be 1.00 for convenience of explanation. The anode current value in the high electron emitting row is equal to a value over 1.00.

Figure 1C:
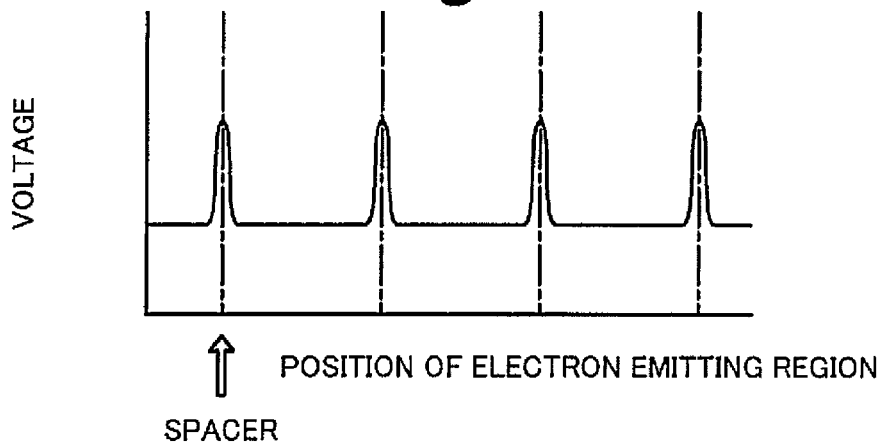

In the embodiment 1, the aging process in which the voltage higher than that of the electron emitting region EA in the row showing the low initial electron emitting state (low electron emitting row) is applied to the electron emitting region EA in the row showing the high initial electron emitting state for a predetermined time is executed. Specifically speaking, the voltage higher than that of the electron emitting region EA locating at the position away from the spacer 40 is applied to the electron emitting region EA locating at the position adjacent to the spacer 40 for a predetermined time (specifically speaking, 100 hours). In the embodiment 1 or the embodiments 2 to 5, which will be explained hereinafter, the line-sequential driving system is also used in the aging process. As shown in FIG. 1C, a voltage applying pattern has a pattern which is analogous or similar to that of the measurement results of the initial electron emitting states schematically shown in FIG. 1A.

In the embodiment 1, at the point of time of completion of the aging process, a difference between the electron emitting state after the aging process of the high electron emitting row and the electron emitting state after the aging process of the low electron emitting row is set to a desired electron emitting state difference. More specifically speaking, at the point of time of completion of the aging process as a first construction, the electron emitting state after the aging process of the high electron emitting row is set to the electron emitting state lower than the electron emitting state after the aging process of the low electron emitting row. The low electron emitting state is shown by the "target value of the electron emitting state after the aging process" shown by the alternate long and two short dashes line in the diagrams.

Or, in the embodiment 1, in the aging processing step, the voltage decided on the basis of the difference between the measurement value of the initial electron emitting state in each electron emitting region EA and the predetermined electron emitting state reference value (refer to the broken line in FIG. 1A) is applied to each electron emitting region EA for a predetermined time. Specifically speaking, the electron emitting state reference value is previously decided, the voltage $V_{H\text{-}Var}$ which is applied to the high electron emitting row is decided on the basis of the difference between the initial electron emitting state measurement value of the high electron emitting row and the electron emitting state reference value. The voltage $V_{L\text{-}Var}$ which is applied to the low electron emitting row is decided on the basis of the difference between the initial electron emitting state measurement value of the low electron emitting row and the electron emitting state reference value. However, in the embodiment 1, as mentioned above, since there is hardly any variations in each of the initial electron emitting states in the high electron emitting row and the initial electron emitting states in the low electron emitting row which were obtained in the initial electron emitting state measuring step, the voltage $V_{H\text{-}Var}$ is set to the voltage $V_{H\text{-}Var}$ or $V_{L\text{-}Fix}$ and the voltage $V_{L\text{-}Var}$ is set to the voltage $V_{L\text{-}Fix}$. Assuming that the mean value of the initial electron emitting states in the low electron emitting row which were obtained in the initial electron emitting state measuring step is equal to 1.00, the mean value of the initial electron emitting states in the high electron emitting row is equal to 1.02.

The measurement results of the electron emitting states after the aging process obtained in the embodiment 1 are schematically shown in FIG. 1B. In the embodiment 1, assuming that the mean value of the measurement values (anode current values) of the electron emitting states after the aging process of the low electron emitting row is equal to 1.00 for convenience of explanation, the target value (target value of the anode current value) of the electron emitting states after the aging process of the high electron emitting row is equal to 0.97. In the aging process, the mean value of all of the initial electron emitting state measurement values after the aging process of the low electron emitting row (the mean value of all of the anode current values) is set to a reference value, the voltage $V_{H\text{-}Var}$ which is applied to the high electron emitting row is decided on the basis of the difference between the initial electron emitting state measurement value of the high electron emitting row and the obtained reference value and the predetermined low voltage $V_{L\text{-}Fix}$ is applied to the low electron emitting row. Specifically speaking, since the voltage $V_{H\text{-}Var}$ is based on the difference between the initial electron emitting state measurement value of the high electron emitting row and the reference value, there is a case where the voltage $V_{H\text{-}Var}$ changes moment by moment. However, for example, a value of (the voltage $V_{H\text{-}Var}$/the voltage $V_{L\text{-}Fix}$) is controlled so that the anode current value is equal to 4/1. In place of it, it is also possible to apply the predetermined high voltage $V_{H\text{-}Fix}$ to the high electron emitting row and apply the predetermined low voltage $V_{L\text{-}Fix}$ to the low electron emitting row.

Figure 6:
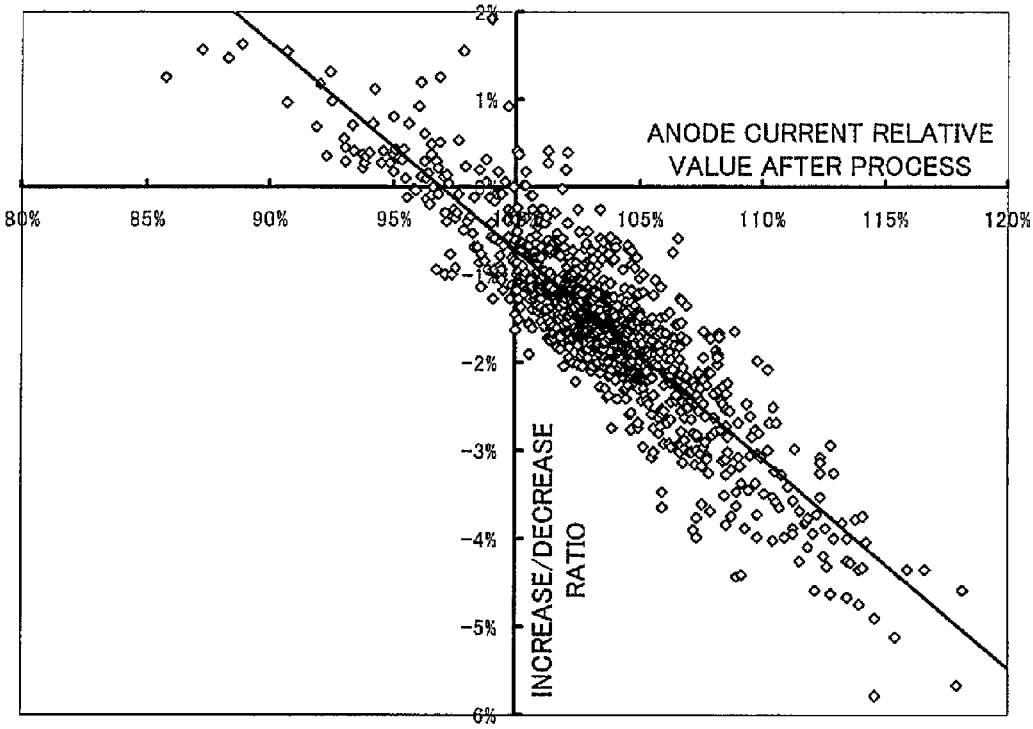
FIG. 6 is a graph showing a relation between an anode current relative value in the electron emitting state after the aging process and an increase/decrease ratio of the anode current relative value obtained when the flat panel display apparatus has been actually operated for a certain time.

FIG. 6 shows a relation between an anode current relative value in the electron emitting state after the aging process (hereinbelow, referred to as an "anode current relative value after the process"; unit is %) and an increase/decrease ratio of the anode current relative value obtained (hereinbelow, referred to as an "increase/decrease ratio"; unit is %) when the display apparatus has been actually operated for a certain time. As mentioned above, the anode current relative value is a value (unit is %) obtained by dividing (the value of the anode current in the electron emitting region locating near the spacer) by (the value of the anode current in the electron emitting region which is sufficiently away from the spacer). When the increase/decrease ratio is equal to 0%, this means that the anode current relative value obtained after the aging process and the anode current relative value obtained after the display apparatus has been actually operated for a certain time are equalized. In other words, it means that a state of the aging change of the electron emitting state of the high electron emitting row and a state of the aging change of the electron emitting state of the low electron emitting row are equalized. In FIG. 6, an axis of abscissa indicates the anode current relative value after the process and an axis of ordinate indicates the increase/decrease ratio.

It will be understood from FIG. 6 that there is a good correlation between the anode current relative value after the process and the increase/decrease ratio. It will be also understood from FIG. 6 that when the anode current relative value after the process is set to about 97%, the increase/decrease ratio is equal to 0%. That is, in order to accomplish the increase/decrease ratio of 0%, when the anode current value after the aging process in the low electron emitting row is assumed to be 1.00, it is sufficient to set the anode current value after the aging process in the high electron emitting row to 0.97.

In the following explanation, assuming that the measurement value of the electron emitting state after the aging process in the electron emitting row serving as a reference in order to accomplish the increase/decrease ratio of 0% is equal to 1.00, a difference between this value and the measurement value of the electron emitting state after the aging process in the electron emitting row substantially serving as a processing target in the aging process is referred to as a "target difference" for convenience of explanation. In the embodiment 1 or the embodiment 2, which will be explained hereinafter, the electron emitting row serving as a reference is the low electron emitting row. In the embodiments 3 and 4, which will be explained hereinafter, it is the high electron emitting row. In the embodiment 1 or the embodiments 2 and 3, which will be explained hereinafter, the electron emitting row serving as a processing target is the high electron emitting row. In the embodiment 4, which will be explained hereinafter, it is the low electron emitting row.

That is, at the point of time of completion of the aging process, the electron emitting state after the aging process of the high electron emitting row is assumed to be such an electron emitting state that the aging change ratio of the electron emitting state at the time of the actual displaying operation in the display apparatus lies within a predetermined range. Specifically speaking, an aging change state of the electron emitting state of the high electron emitting row is made to approach an aging change state of the electron emitting state of the low electron emitting row as much as possible. More specifically speaking, the predetermined range is set to the increase/decrease ratio of 0% and such an electron emitting state that the increase/decrease ratio lies within the predetermined range is set so that the anode current relative value after the process is equal to 97%. Therefore, the target difference is equal to minus 3%. Actually, it is sufficient to set such an electron emitting state that the aging change ratio of the electron emitting state at the time of the actual displaying operation in the display apparatus lies within the target difference ±1%. More specifically speaking, in the embodiment 1 or the embodiments 2 to 5, which will be explained hereinafter, it is sufficient to set the anode current relative value after the process to a value within a range from 95% to 99%. Or, for example, a range of 0%±0.5% can be mentioned as a predetermined range (range of the increase/decrease ratio).

In the actual displaying operation state in the display apparatus, the electron emitting state in the electron emitting region is controlled in such a manner that when the same drive signal is inputted, the electron emitting state of the high electron emitting row and the electron emitting state of the low electron emitting row are equalized. Specifically speaking, the voltage corresponding to the signal obtained by multiplying the value of the drive signal to the electron emitting region in the row showing the high initial electron emitting state (the row close to the spacer 40) by (1/0.97) is applied as a potential difference between the cathode electrode 11 and the gate electrode 13 to the cathode electrode 11 and the gate electrode 13 from the cathode electrode control circuit 31 and the gate electrode control circuit 32. The voltage corresponding to the value of the drive signal to the electron emitting region in the row showing the low initial electron emitting state (the row which is not close to the spacer 40) is applied as a potential difference between the cathode electrode 11 and the gate electrode 13 to the cathode electrode 11 and the gate electrode 13 from the cathode electrode control circuit 31 and the gate electrode control circuit 32.

By executing the processing method of the flat panel display apparatus of the embodiment 1 described above, the electron emitting characteristics in the high electron emitting row are actively slightly deteriorated more than the electron emitting characteristics in the low electron emitting row. Therefore, a desired difference can be provided between the electron emitting state in the electron emitting region near the spacer and the electron emitting state in the electron emitting region locating at the position away from the spacer. By properly controlling the electron emitting states in the electron emitting regions, the display apparatus having the high display quality can be provided. At the point of time of completion of the aging process, the electron emitting state after the aging process of the high electron emitting row is set to such an electron emitting state that the aging change ratio of the electron emitting state at the time of the actual displaying operation in the display apparatus lies within the predetermined range. Therefore, although the aging change occurs in the emitting state of the electrons from the electron emitting region, a variation in aging change as a whole display apparatus can be reduced as much as possible.

Embodiment 2

Figure 2A:
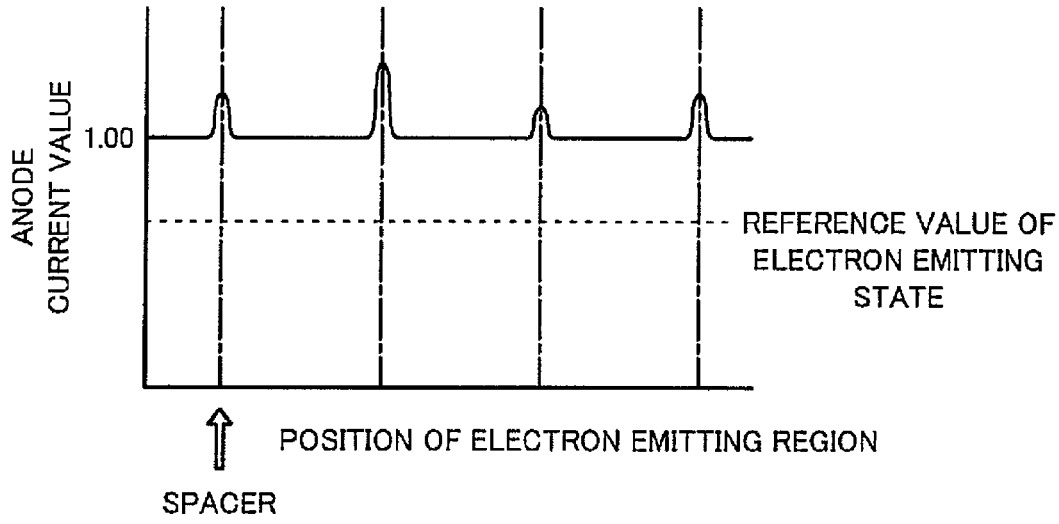
FIGS. 2A and 2B are graphs each schematically showing measurement results of an initial electron emitting state in the initial electron emitting state measuring step and measurement results of an electron emitting state after completion of the aging processing step which were obtained in an embodiment 2.
Figure 3A:
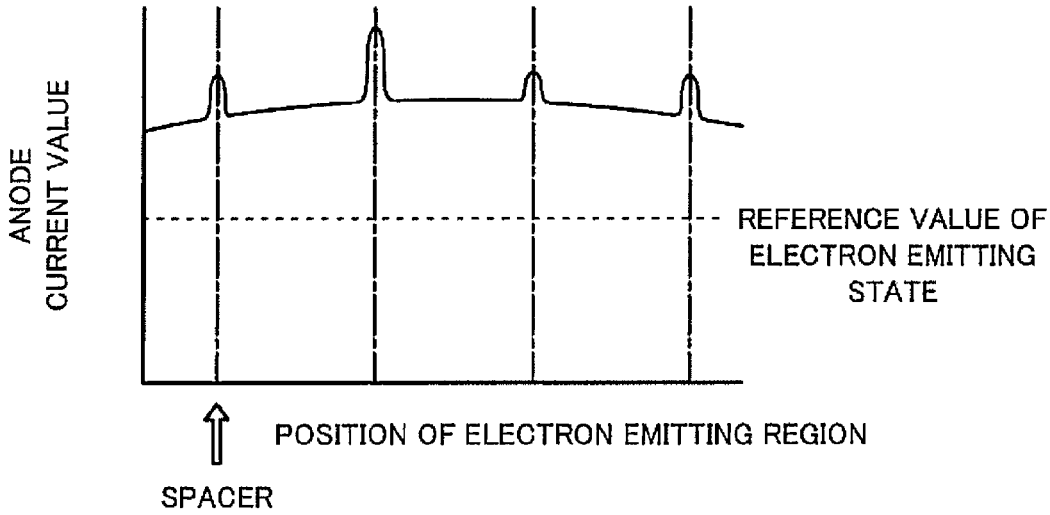
FIGS. 3A and 3B are graphs each schematically showing measurement results of the initial electron emitting state in an initial electron emitting state measuring step and measurement results of an electron emitting state after completion of the aging processing step which were obtained in another example of the embodiment 2.

The embodiment 2 is a modification of the embodiment 1. In the embodiment 1, the case where there is hardly any variation in each of the initial electron emitting states in the high electron emitting row and the initial electron emitting states in the low electron emitting row which were obtained in the initial electron emitting state measuring step has been described. In the embodiment 2, first, the initial electron emitting state measuring step is executed in a manner similar to the embodiment 1. Measurement results of the obtained initial electron emitting states are schematically shown in FIGS. 2A and 3A. There are large variations in the initial electron emitting states in the high electron emitting row. However, also in the embodiment 2, the electron emitting region EA locating near the spacer 40 shows the high initial electron emitting state and the electron emitting region EA locating at the position away from the spacer 40 shows the low initial electron emitting state. The rows where the electron emitting regions EA showing the low initial electron emitting state are located occupy the majority rows. That is, the embodiment 2 also corresponds to the case A. In the example shown in FIG. 2A, there is hardly any variation in each of the initial electron emitting states in the low electron emitting row. In the example shown in FIG. 3A, there is a variation in each of the initial electron emitting states in the low electron emitting row.

Therefore, in the embodiment 2, the voltage higher than that of the low electron emitting row is applied to the high electron emitting row for a predetermined time in the aging processing step. However, the voltage decided on the basis of the difference between the measurement result of the initial electron emitting state in each electron emitting region EA and the predetermined electron emitting state reference value (refer to the broken lines in FIGS. 2A and 3A) is applied to each electron emitting region EA for a predetermined time. Specifically speaking, the electron emitting state reference value is previously decided, the voltage $V_{H\text{-}Var}$ which is applied to the high electron emitting row is decided on the basis of the difference between the initial electron emitting state measurement value of the high electron emitting row and the electron emitting state reference value, and the voltage $V_{L\text{-}Var}$ which is applied to the low electron emitting row is decided on the basis of the difference between the initial electron emitting state measurement value of the low electron emitting row and the electron emitting state reference value. The voltage applying pattern has a pattern which is analogous or similar to that of the measurement results of the initial electron emitting states schematically shown in each of FIGS. 2A and 3A.

Figure 2B:
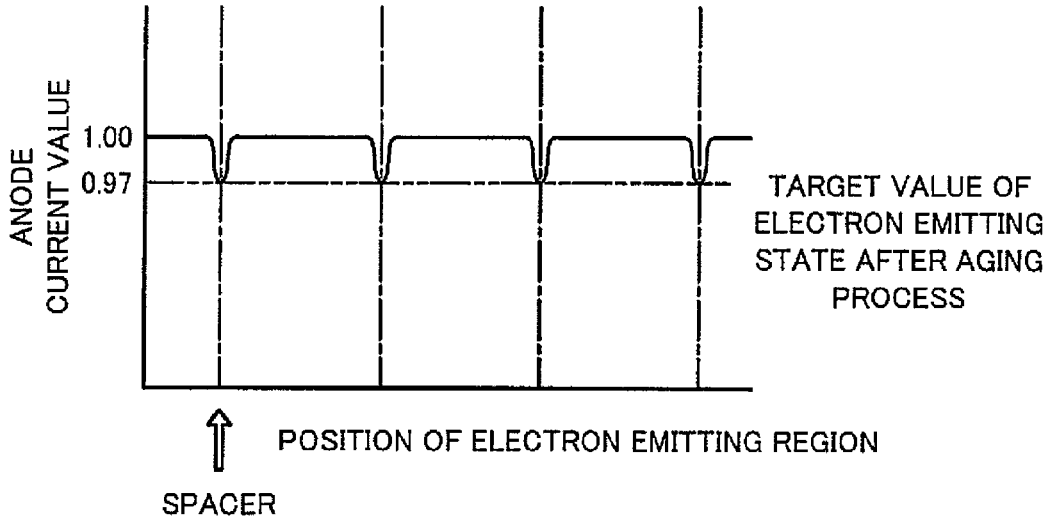
Figure 3B:
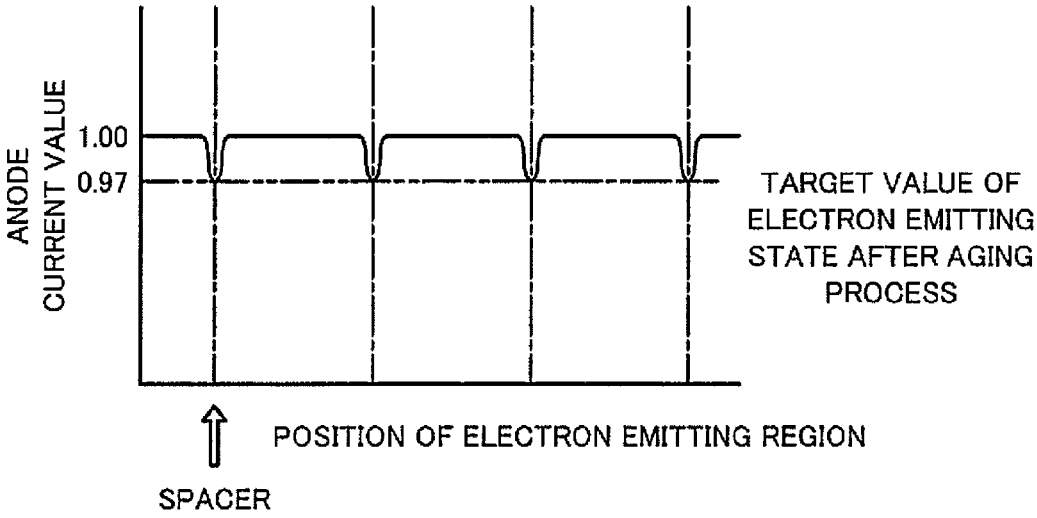

Thus, after the aging process, the electron emitting states similar to those described in the embodiment 1 can be obtained as shown in FIGS. 2B and 3B.

Embodiment 3

Figure 4A:
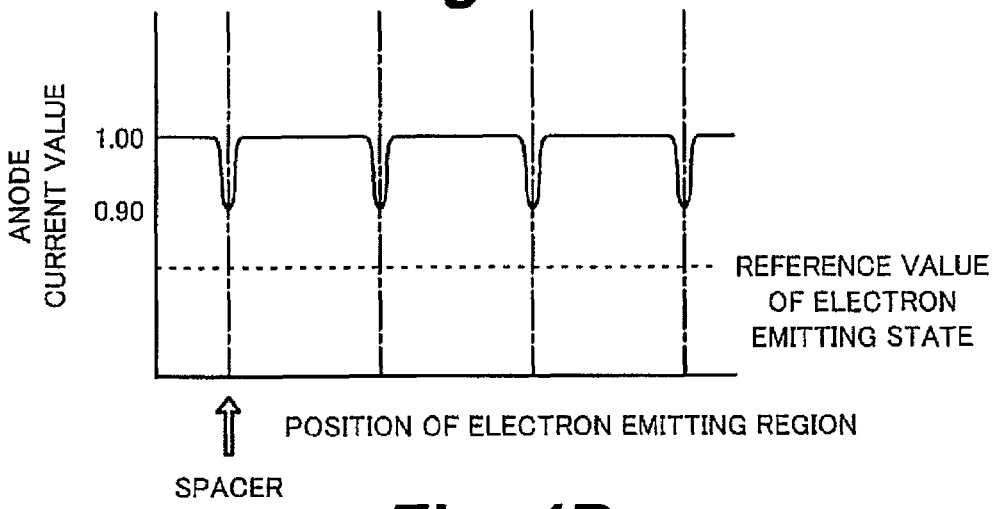
FIGS. 4A, 4B, and 4C are graphs each schematically showing measurement results of the initial electron emitting state in an initial electron emitting state measuring step obtained in an embodiment 3, measurement results of an electron emitting state after completion of the aging processing step, and a voltage which is applied to an electron emitting region.

The embodiment 3 is also a modification of the embodiment 1 but relates to a second construction. Also in the embodiment 3, there is hardly any variation in each of the initial electron emitting states in the high electron emitting row and the initial electron emitting states in the low electron emitting row which were obtained in the initial electron emitting state measuring step. However, in the embodiment 3, first, the initial electron emitting state measuring step is executed in a manner similar to the embodiment 1. Measurement results of the obtained initial electron emitting states are schematically shown in FIG. 4A. An amount of electrons emitted from the electron emitting region EA locating near the spacer 40 is smaller than an amount of electrons emitted from the electron emitting region EA locating at the position away from the spacer 40. That is, the electron emitting region EA locating near the spacer 40 shows the low initial electron emitting state and the electron emitting region EA locating at the position away from the spacer 40 shows the High initial electron emitting state. The rows where the electron emitting regions EA showing the high initial electron emitting state are located occupy the majority rows. That is, the embodiment 3 corresponds to the case B.

In the embodiment 3, such a difference exceeding the electron emitting state that it lies within the predetermined range for accomplishing the target 0% of the increase/decrease ratio (that is, target difference: minus 3%) exists between the low initial electron emitting state shown by the electron emitting region EA locating near the spacer 40 and the high initial electron emitting state shown by the electron emitting region EA locating at the position away from the spacer 40. That is, assuming that the anode current value of the high electron emitting row is equal to 1.00, the anode current value of the low electron emitting row is equal to 0.90.

Figure 4B:
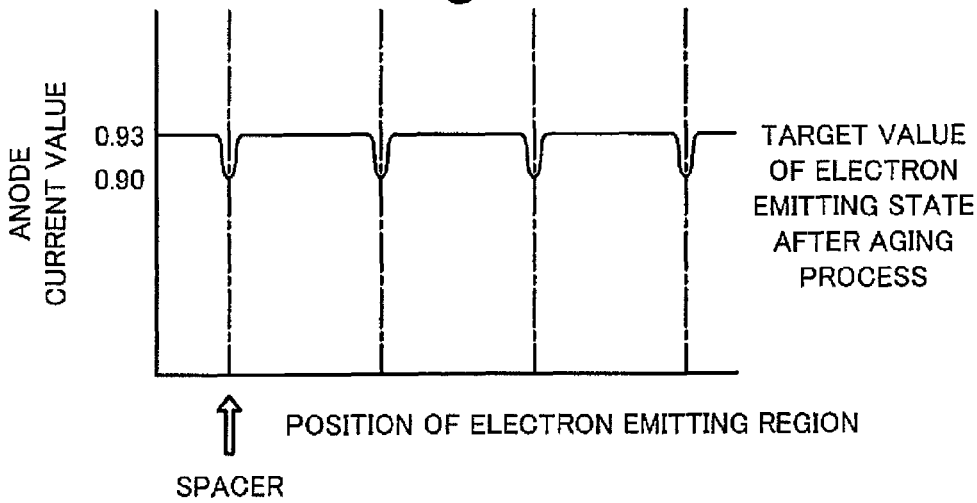
Figure 4C:
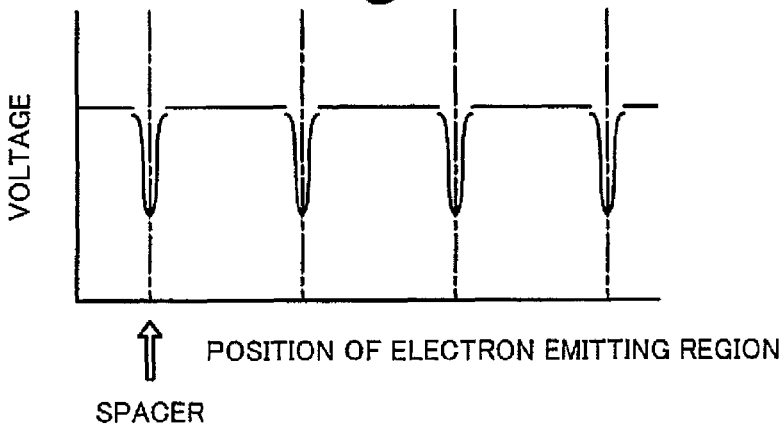

Also in the embodiment 3, the aging process for applying the voltage higher than that of the low electron emitting row to the high electron emitting row for a predetermined time is executed. Specifically speaking, the voltage higher than that of the electron emitting region EA near the spacer 40 is applied to the electron emitting region EA locating at the position away from the spacer 40 for a predetermined time in a manner similar to the embodiment 1. As shown in FIG. 4C, the voltage applying pattern has a pattern which is analogous or similar to that of the measurement results of the initial electron emitting states schematically shown in FIG. 4A.

Also in the embodiment 3, at the point of time of completion of the aging process, a difference between the electron emitting state after the aging process of the high electron emitting row and the electron emitting state after the aging process of the low electron emitting row is set to a desired electron emitting state difference. More specifically speaking, at the point of time of completion of the aging process as a second construction, the electron emitting state after the aging process of the high electron emitting row is set to the electron emitting state higher than the electron emitting state after the aging process of the low electron emitting row. That is, the predetermined range is set to the increase/decrease ratio of 0% and such an electron emitting state that it lies within the predetermined range is set to the anode current relative value after the process of 97%. The target difference is equal to minus 3%. More specifically speaking, by executing the aging process, the anode current value of the low electron emitting row is set to 0.90 and the anode current value of the high electron emitting row is set to 0.93. Measurement results of the electron emitting states after the aging process obtained in the embodiment 3 are schematically shown in FIG. 4B.

Or, in the embodiment 3, in the aging processing step, the voltage decided on the basis of a difference between the measurement value of the initial electron emitting state of each electron emitting region EA and the predetermined electron emitting state reference value (refer to a broken line in FIG. 4A) is applied to each electron emitting region EA for a predetermined time. Specifically speaking, the electron emitting state reference value is previously decided, the voltage $V_{H\text{-}Var}$ which is applied to the electron emitting region in the row showing the high initial electron emitting state is decided on the basis of the difference between the initial electron emitting state measurement value of the electron emitting region in the row showing the high initial electron emitting state and the electron emitting state reference value. The voltage $V_{L\text{-}Var}$ which is applied to the electron emitting region in the row showing the low initial electron emitting state is decided on the basis of the difference between the initial electron emitting state measurement value of the electron emitting region in the row showing the low initial electron emitting state and the electron emitting state reference value. However, also in the embodiment 3, as mentioned above, since there is hardly any variation in each of the initial electron emitting states in the high electron emitting row and the initial electron emitting states in the low electron emitting row which were obtained in the initial electron emitting state measuring step, the voltage $V_{H\text{-}Var}$ is set to the voltage $V_{H\text{-}Fix}$ and the voltage $V_{L\text{-}Var}$ is set to the voltage $V_{L\text{-}Fix}$ as will be explained hereinbelow. That is, in the aging process, the mean value H of the initial electron emitting state measurement values of the high electron emitting row is obtained and the mean value L of the initial electron emitting state measurement values of the low electron emitting row is obtained. On the basis of the mean value H and the mean value L, the predetermined high voltage $V_{H\text{-}Fix}$ is applied to the high electron emitting row and the predetermined low voltage $V_{L\text{-}Fix}$ is applied to the low electron emitting row. The value of (the voltage $V_{H\text{-}Fix}$/the voltage $V_{L\text{-}Fix}$) is controlled so that the anode current value is equal to 4/1.

In the actual displaying operation state in the display apparatus in the embodiment 3, the electron emitting state in the electron emitting region is controlled in such a manner that when the same drive signal is inputted, the electron emitting state of the high electron emitting row and the electron emitting state of the low electron emitting row are equalized. Specifically speaking, the voltage corresponding to the value of the drive signal to the electron emitting region in the row showing the high initial electron emitting state (the row locating at the position away from the spacer 40) is applied as a potential difference between the cathode electrode 11 and the gate electrode 13 to the cathode electrode 11 and the gate electrode 13 from the cathode electrode control circuit 31 and the gate electrode control circuit 32. The voltage corresponding to the signal obtained by multiplying the value of the drive signal to the electron emitting region in the row showing the low initial electron emitting state (the row near the spacer 40) by (0.93/0.90) is applied as a potential difference between the cathode electrode 11 and the gate electrode 13 to the cathode electrode 11 and the gate electrode 13 from the cathode electrode control circuit 31 and the gate electrode control circuit 32.

By executing the processing method of the flat panel display apparatus of the embodiment 3 described above, the electron emitting characteristics in the high electron emitting row are actively slightly deteriorated more than the electron emitting characteristics in the low electron emitting row. Therefore, a desired difference can be provided between the electron emitting state in the electron emitting region near the spacer and the electron emitting state in the electron emitting region locating at the position away from the spacer. By properly controlling the electron emitting states in the electron emitting regions, the display apparatus having the high display quality can be provided. At the point of time of completion of the aging process, the electron emitting state after the aging process of the low electron emitting row is set to such an electron emitting state that the aging change ratio of the electron emitting state at the time of the actual displaying operation in the display apparatus lies within the predetermined range. Therefore, although the aging change occurs in the emitting state of the electrons from the electron emitting region, a variation in aging change as a whole display apparatus can be reduced as much as possible.

Embodiment 4

Figure 5A:
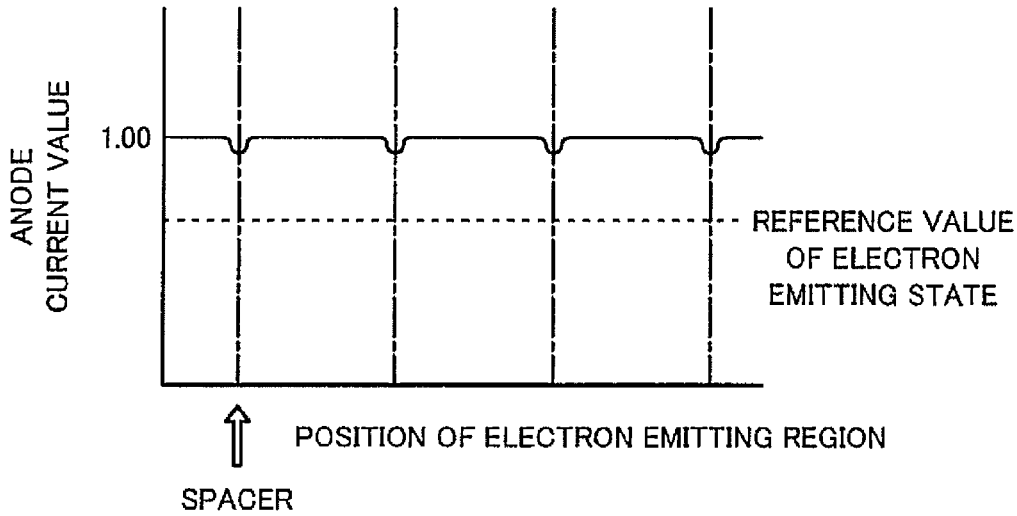
FIGS. 5A, 5B, and 5C are graphs each schematically showing measurement results of the initial electron emitting state in an initial electron emitting state measuring step obtained in an embodiment 4, measurement results of an electron emitting state after completion of the aging processing step, and a voltage which is applied to an electron emitting region.

An embodiment 4 relates to a processing method of the flat panel display apparatus according to the second aspect of the invention. Measurement results of the initial electron emitting states obtained by executing the initial electron emitting state measuring step in a manner similar to the embodiment 1 are schematically shown in FIG. 5A. There is hardly any variation in each of the initial electron emitting states in the high electron emitting row and the initial electron emitting states in the low electron emitting row which were obtained in the initial electron emitting state measuring step. In a manner similar to the embodiment 3, an amount of electrons emitted from the electron emitting region EA locating near the spacer 40 is smaller than an amount of electrons emitted from the electron emitting region EA locating at the position away from the spacer 40. That is, the electron emitting region EA locating near the spacer 40 shows the low initial electron emitting state and the electron emitting region EA locating at the position away from the spacer 40 shows the high initial electron emitting state. The rows on which the electron emitting regions EA showing the high initial electron emitting state are located and occupy the majority rows. That is, the embodiment 4 also corresponds to the case B.

The embodiment 4 differs from the embodiment 3 with respect to a point that there is hardly any difference between the low initial electron emitting state shown by the electron emitting region EA locating near the spacer 40 and the high initial electron emitting state shown by the electron emitting region EA locating at the position away from the spacer 40.

That is, in the embodiment 3, such a difference is large (that is, in the example described in the embodiment 3, assuming that the anode current value in the electron emitting region EA showing the high initial electron emitting state is equal to 1.00, the anode current value in the electron emitting region EA showing the low initial electron emitting state is equal to 0.90). Therefore, the aging process for applying the voltage higher than that of the low electron emitting row to the high electron emitting row for a predetermined time is executed. At the point of time of completion of the aging process, a difference between the electron emitting state after the aging process of the high electron emitting row and the electron emitting state after the aging process of the low electron emitting row is set to a desired electron emitting state difference. More specifically speaking, the electron emitting state after the aging process of the high electron emitting row is set to the electron emitting state higher than the electron emitting state after the aging process of the low electron emitting row.

In the embodiment 4, such a difference is small (that is, specifically speaking, assuming that the anode current value of the high electron emitting row is equal to 1.00, the anode current value of the low electron emitting row is equal to 0.99) as mentioned above. Therefore, even if the same aging process as that in the embodiment 3 is executed, it is difficult to obtain the target difference minus 3% for accomplishing the target 0% of the increase/decrease ratio.

Therefore, in the embodiment 4, after executing the initial electron emitting state measuring step of applying the predetermined voltage to each electron emitting region EA to thereby allow electrons to be emitted from each electron emitting region EA and measuring the initial electron emitting states in the electron emitting regions in the predetermined row, the aging process for applying the voltage based on the difference between the measurement value of the initial electron emitting state in each electron emitting region EA and the predetermined electron emitting state reference value to each electron emitting region for the predetermined time is executed.

Figure 5B:
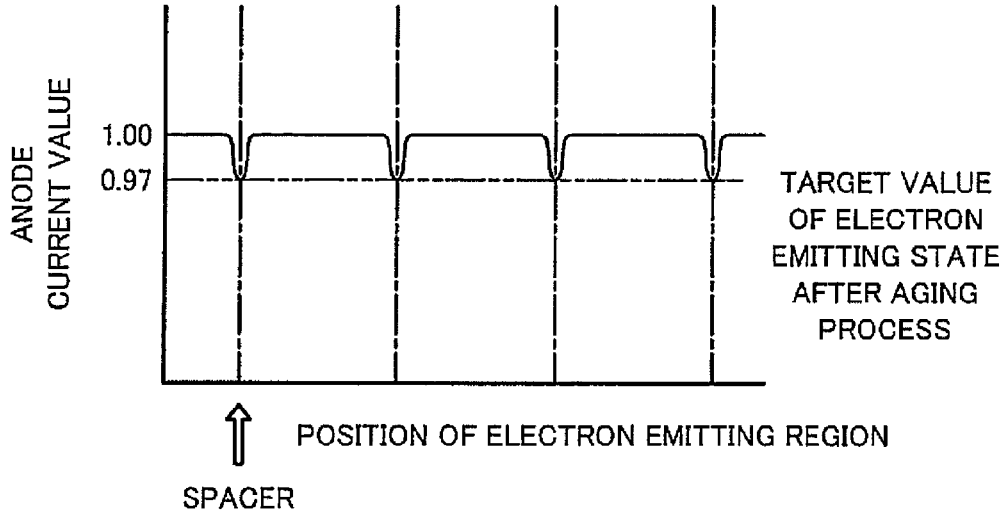
Figure 5C:
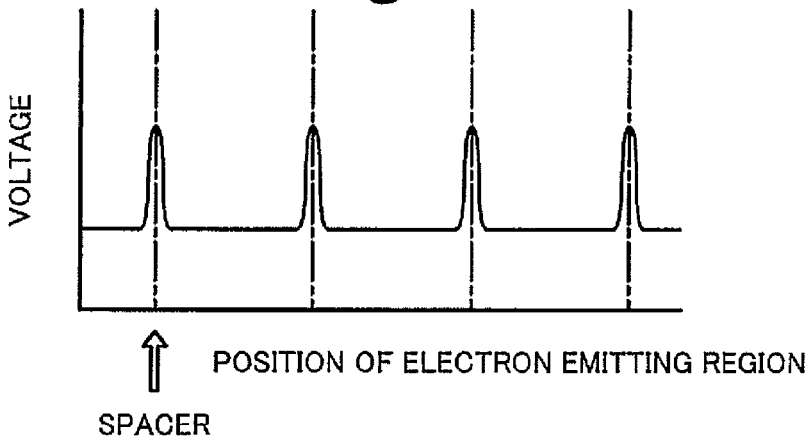

Specifically speaking, in the embodiment 4, the predetermined high voltage $V_{H\text{-}Fix}$ is applied to the electron emitting region EA (low electron emitting row) which is located near the spacer 40 and is in the low initial electron emitting state and the predetermined low voltage $V_{L\text{-}Fix}$ is applied to the electron emitting region EA (high electron emitting row) which is located at the position away from the spacer 40 and is in the high initial electron emitting state as shown in FIG. 5C.

Measurement results of the electron emitting states after the aging process obtained in the embodiment 4 are schematically shown in FIG. 5B. In the embodiment 4, assuming that the anode current value in the electron emitting state after the aging process of the high electron emitting row is equal to 1.00, the anode current value in the electron emitting state after the aging process of the low electron emitting row is set to 0.97. In this manner, the electron emitting state similar to that described in the embodiment 1 can be obtained.

Embodiment 5

An embodiment 5 relates to a processing method of the flat panel display apparatus according to the third aspect of the invention. In the embodiment 5, different from the embodiments 1 to 4, the initial electron emitting state measuring step is omitted. In the embodiment 5, the aging process for applying the voltage higher than that of the electron emitting region EA in the row which is presumed to show the low initial electron emitting state to the electron emitting region EA in the row which is presumed to show the high initial electron emitting state for the predetermined time is executed.

Specifically speaking, in the embodiment 5, the row which is presumed to show the high initial electron emitting state and the row which is presumed to show the low initial electron emitting state can be decided by executing a step similar to the initial electron emitting state measuring step in the embodiment 1 to a number of display apparatuses and collecting the data. The high-voltage is applied for the predetermined time. Specifically speaking, it is sufficient to apply the predetermined high voltage $V_{H\text{-}Fix}$ to the electron emitting region in the row showing the high initial electron emitting state and apply the predetermined low voltage $V_{L\text{-}Fix}$ to the electron emitting region in the row showing the low initial electron emitting state. Those voltages $V_{H\text{-}Fix}$ and $V_{L\text{-}Fix}$ can be decided by, for example, executing a step similar to the aging process in the embodiment 1 and collecting the data and, further, by grasping a relation between the anode current relative value after the process and its increase/decrease ratio.

Although the invention has been described above on the basis of the preferred embodiments, the invention is not limited to those embodiments. The constructions and structures of the flat panel display apparatuses, cathode panels, anode panels, cold cathode field electron emitting display apparatuses, and cold cathode field electron emitting devices described in the embodiments are shown as examples and can be properly changed. Although the display apparatus has been described mainly with respect to the apparatus of the color display, the invention can be also applied to the display apparatus of a monochromatic display.

In the embodiments, although the column voltage $V_{Col}$ which is applied to the M electron emitting regions arranged on one row has been set to be constant in the aging process, the column voltage $V_{Col}$ which is applied to the M electron emitting regions arranged on one row can be made different. In this case, for example, it is sufficient that by using a method whereby the light emitting states of the phosphor regions corresponding to the electron emitting regions are measured by using a CCD camera or the like, the initial electron emitting states of the M electron emitting regions arranged on one row are individually and independently measured. In the embodiments, although the predetermined row has been set to all of the rows constructing the display apparatus, it can be also set to one or a plurality of rows adjacent to the spacer and one or a plurality of rows locating at an intermediate position between the spacers.

Further, in the embodiments, although the difference between the electron emitting state after the aging process of the high electron emitting row and the electron emitting state after the aging process of the low electron emitting row is set in such a manner that the former is set to the electron emitting state lower than the latter or the former is set to the electron emitting state higher than the latter, the invention is not limited to such an example but the difference between the former and the latter may be allowed to approach 0 as close as possible. However, in this case, the anode current relative value after the process is equal to about 100% and its increase/decrease ratio is equal to, for instance, about minus 0.8% in the example shown in FIG. 6. Therefore, a difference occurs in the measurement relative values of the electron emitting states between the electron emitting state after the aging process and the electron emitting state at the time when the display apparatus has actually been operated for a certain time. To compensate such a difference, accordingly, it is necessary to perform an aging compensation of the value of the drive signal to the electron emitting region.

Although the field emission device has been described mainly with respect to the aspect in which one electron emitting portion corresponds to one opening portion, an aspect in which a plurality of electron emitting portions correspond to one opening portion or an aspect in which one electron emitting portion corresponds to a plurality of opening portions can be also used depending on the structure of the field emission device. Or, an aspect in which a plurality of first opening portions are formed in the gate electrode, a second opening portion communicated with the plurality of first opening portions regarding the insulating layer are provided, and one or plurality of electron emitting portions are provided can be also used.

The electron emitting region can be also made of an electron emitting device generally called a surface conduction electron emitting device. The surface conduction electron emitting device is formed in such a manner that it is made of a conductive material such as tin oxide $SnO_2$, gold Au, indium oxide $In_2O_3$/tin oxide $SnO_2$, carbon, or palladium oxide PdO on the supporting plate made of, for example, glass, it has a micro area, and a plurality of pairs of electrodes arranged with a predetermined interval (gap) are formed in a matrix form. The thin carbon film is formed on each electrode. The row-directional wiring is connected to one (for example, first electrode) of the pair of electrodes, and the column-directional wiring is connected to the other one (for example, second electrode) of the pair of electrodes. By applying the voltages to the pair of electrodes (first electrode and second electrode), the electric field is applied to the thin carbon films which face each other through the gap and the electrons are emitted from the thin carbon films. By making the electrons collide with the phosphor region on the anode panel, the phosphor region is excited and emits the light, so that the desired image can be obtained. Or, the electron emitting region can be also made of a metal/insulating film/metal type device.

It should be understood by those skilled in the art that various modifications, combinations, sub-combinations and alterations may occur depending on design requirements and other factors insofar as they are within the scope of the appended claims or the equivalents thereof.

What is claimed is:

1. A processing method of a flat panel display apparatus in which a cathode panel having electron emitting regions arranged on a supporting plate along a row direction and a column direction in a 2-dimensional matrix form and an anode panel having phosphor regions and an anode electrode are joined in a peripheral portion, spacers are arranged between the cathode panel and the anode panel along the row direction, and a space sandwiched between the cathode panel and the anode panel is held in a vacuum state, comprising the steps of:

(A) applying a first voltage to each of the electron emitting regions to thereby allow electrons to be emitted from each of the electron emitting regions and measuring initial electron emitting states in electron emitting regions in at least a first row and a second row; and (B) executing an aging process by applying a second voltage to a first electron emitting region and a third voltage to a second electron emitting region, wherein the first electron emitting region is in a first row measured in step (A) to show a high initial electron emitting state, and the second electron emitting region is in a second row measured in step (A) to show a low initial electron emitting state, wherein the second voltage is higher than the third voltage.

2. The processing method of the flat panel display apparatus, according to claim 1, wherein at a point of time of completion of the aging process, a difference between an electron emitting state after the aging process of the electron emitting region in the first row measured in step (A) to show the high initial electron emitting state and an electron emitting state after the aging process of the electron emitting region in the second row measured in step (A) to show the low initial electron emitting state is set to a desired electron emitting state difference.

3. The processing method of the flat panel display apparatus, according to claim 2, wherein at the point of time of completion of the aging process, the electron emitting state after the aging process of the electron emitting region in the first row measured in step (A) to show the high initial electron emitting state is set to an electron emitting state lower than the electron emitting state after the aging process of the electron emitting region in the second row measured in step (A) to show the low initial electron emitting state.

4. The processing method of the flat panel display apparatus, according to claim 3, wherein the electron emitting region in the first row measured in step (A) to show the high initial electron emitting state is close to a spacer.

5. The processing method of the flat panel display apparatus, according to claim 3, wherein at the point of time of completion of the aging process, the electron emitting state after the aging process of the electron emitting region in the first row measured in step (A) to show the high initial electron emitting state is such an electron emitting state that an aging change ratio of an electron emitting state at a time of an actual displaying operation in the flat panel display apparatus lies within a predetermined range.

6. The processing method of the flat panel display apparatus, according to claim 3, wherein in an actual displaying operation state in the flat panel display apparatus, the electron emitting state of the electron emitting regions is controlled in such a manner that when a same drive signal is inputted, the electron emitting state of the electron emitting region in the first row measured in step (A) to show the high initial electron emitting state and the electron emitting state of the electron emitting region in the second row measured in step (A) to show the low initial electron emitting state are equalized.

7. The processing method of the flat panel display apparatus, according to claim 2, wherein at the point of time of completion of the aging process, the electron emitting state after the aging process of the electron emitting region in the first row measured in step (A) to show the high initial electron emitting state is set to a higher electron emitting state than the electron emitting state after the aging process of the electron emitting region in the second row measured in step (A) to show the low initial electron emitting state.

8. The processing method of the flat panel display apparatus, according to claim 7, wherein the electron emitting region in the second row measured in step (A) to show the low initial electron emitting state is close to a spacer.

9. The processing method of the flat panel display apparatus, according to claim 7, wherein at the point of time of completion of the aging process, the electron emitting state after the aging process of the electron emitting region in the second row measured in step (A) to show the low initial electron emitting state is such an electron emitting state that an aging change ratio of an electron emitting state at a time of an actual displaying operation in the flat panel display apparatus lies within a predetermined range.

10. The processing method of the flat panel display apparatus, according to claim 7, wherein in an actual displaying operation state in the flat panel display apparatus, the electron emitting state of the electron emitting regions is controlled in such a manner that when a same drive signal is inputted, the electron emitting state of the electron emitting region in the first row measured in step (A) to show the high initial electron emitting state and the electron emitting state of the electron emitting region in the second row measured in step (A) to show the low initial electron emitting state are equalized.

11. A processing method of a flat panel display apparatus in which a cathode panel having electron emitting regions arranged on a supporting plate along a row direction and a column direction in a 2-dimensional matrix form and an anode panel having phosphor regions and an anode electrode are joined in a peripheral portion, spacers are arranged between the cathode panel and the anode panel along the row direction, and a space sandwiched between the cathode panel and the anode panel is held in a vacuum state, comprising the steps of:

(A) applying a first voltage to each of the electron emitting regions to thereby allow electrons to be emitted from each of the electron emitting regions and measuring initial electron emitting states in electron emitting regions in at least one row; and (B) executing an aging process by applying a second voltage, based on a difference between a value measured in step (A) of the initial electron emitting state in each of the electron emitting regions and an electron emitting state reference value, to each of the electron emitting regions.

12. A processing method of a flat panel display apparatus in which a cathode panel having electron emitting regions arranged on a supporting plate along a row direction and a column direction in a 2-dimensional matrix form and an anode panel having phosphor regions and an anode electrode are joined in a peripheral portion, spacers are arranged between the cathode panel and the anode panel along the row direction, and a space sandwiched between the cathode panel and the anode panel is held in a vacuum state, comprising the step of:

executing an aging process by applying a first voltage to a first electron emitting region and a second voltage to a second electron emitting region, wherein the first electron emitting region is in a first row which is presumed to show a low initial electron emitting state, and the second electron emitting region is in a second row which is presumed to show a high initial electron emitting state, wherein the first voltage is higher than the second voltage, and wherein the low initial electron emitting state produces lower electron emission than is produced by the high initial electron emitting state.

13. The processing method of the flat panel display apparatus, according to claim 12, wherein the first electron emitting region in the first row which is presumed to show a low initial electron emitting state is close to a spacer.

* * * * *